US007192300B2

(12) United States Patent
Hashiguchi et al.

(10) Patent No.: US 7,192,300 B2
(45) Date of Patent: Mar. 20, 2007

(54) CABLE WITH A MEANDERING PORTION AND A GROUND PORTION SANDWICHED BETWEEN RETAINING ELEMENTS

(75) Inventors: Osamu Hashiguchi, Tokyo (JP); Keizo Kai, Tokyo (JP); Masayuki Kikuchi, Tokyo (JP); Mamoru Suzuki, Tokyo (JP); Nobukazu Kato, Tokyo (JP); Kiyohito Koide, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/147,072

(22) Filed: Jun. 7, 2005

(65) Prior Publication Data

US 2005/0272312 A1 Dec. 8, 2005

(30) Foreign Application Priority Data

Jun. 7, 2004 (JP) ..... 2004-168998
Jun. 28, 2004 (JP) ..... 2004-190452
Nov. 17, 2004 (JP) ..... 2004-333619

(51) Int. Cl.
*H01R 12/24* (2006.01)

(52) U.S. Cl. ..... 439/497

(58) Field of Classification Search ..... 439/578, 439/495, 496, 497, 108, 394, 803
See application file for complete search history.

(56) References Cited

U.S. PATENT DOCUMENTS

| | | | | |
|---|---|---|---|---|
| 4,027,941 | A | 6/1977 | Narozny et al. | |
| 6,062,896 | A * | 5/2000 | Huang | 439/405 |
| 6,332,805 | B2 * | 12/2001 | Aoki | 439/495 |
| 6,692,294 | B2 * | 2/2004 | Kobayashi | 439/496 |
| 6,699,072 | B1 | 3/2004 | Wu | |
| 6,746,268 | B2 * | 6/2004 | Laub et al. | 439/394 |
| 2001/0036767 | A1 | 11/2001 | Igarashi | |
| 2002/0042216 | A1 | 4/2002 | Kato | |

FOREIGN PATENT DOCUMENTS

| | | |
|---|---|---|
| JP | 11260439 | 9/1999 |
| JP | 20011307822 | 11/2001 |

OTHER PUBLICATIONS

European Search Report (ENC.).

* cited by examiner

*Primary Examiner*—Chandrika Prasad
(74) *Attorney, Agent, or Firm*—Collard & Roe, P.C.

(57) ABSTRACT

A connector adapted for connection to cables has a retaining member that aligns and retains the cables. The retaining member has a body portion and a bar-shaped member. The body portion has a plurality of fixing portions for fixedly retaining the bar-shaped member. The cables are firmly sandwiched between the body portion and the bar-shaped member.

17 Claims, 20 Drawing Sheets

CABLE WITH A MEANDERING PORTION AND A GROUND PORTION SANDWICHED BETWEEN RETAINING ELEMENTS

This application claims priority to prior Japanese patent applications JP 2004-168998, JP 2004-190452, and JP 2004-333619, the disclosures of which are incorporated herein by reference.

BACKGROUND OF THE INVENTION

This invention relates to a connector and, more specifically, relates to a connector having a structure for retaining fine coaxial cables.

Conventionally, in electrical connectors, there is a structure described in Japanese Unexamined Patent Application Publication (JP-A) H11-260439 (hereinafter referred to as Patent Document 1) as a structure for retaining a plurality of coaxial cables. A coaxial cable connector of Patent Document 1 is configured such that terminals, each having a U-shape in cross-section and each for fittingly supporting a corresponding one of outer conductors of coaxial cables that are exposed by partly cutting off coatings or jackets of the coaxial cables, are integrally arranged in a row to thereby achieve electrical connection of the coaxial cables collectively. Alternatively, by heating the jackets near connection portions or a terminal in-row arranging member integral with the terminals, end portions of the coaxial cables arrayed horizontally at a predetermined pitch are respectively fitted in the corresponding terminals without partly cutting the jackets. That is, the outer conductors exposed from the melted jackets contact the corresponding terminals so that electrical connection therebetween is collectively achieved. In this manner, this conventional coaxial cable connector has an advantage in that ground coaxial cables can be achieved easily and, yet, reliably.

As a conventional cable connector according to another example, there is one described in Japanese Unexamined Patent Application Publication (JP-A) 2001-307822 (hereinafter referred to as Patent Document 2).

The cable connector described in Patent Document 2 comprises contacts for connection to center conductors or core wires of fine coaxial cables, an insulator fixedly retaining the contacts that are press-fitted thereto, and a shell covering the insulator. The shell comprises a first shell member fixedly retained by the insulator and covering a lower surface of the insulator, and a second shell member fitted over a relatively rear part of the insulator and retained so as to be attachable and detachable. A retaining portion is provided for retaining coated portions of the coaxial cables cooperatively with the insulator in a sandwich manner. The second shell member is in contact with an outer surface of the first shell member.

The plurality of coaxial cables are arranged in a planar fashion while partly exposing outer conductors (shield wires), then the exposed portions of the outer conductors are sandwiched between a pair of metal ground bars, and soldering is carried out while heating them, thereby electrically connecting the outer conductors to the ground bars collectively. In this event, the state of the planar arrangement of the plurality of fine coaxial cables is maintained. The center conductor is exposed at the tip of each fine coaxial cable.

As described above, in the conventional connector, the soldering is implemented by heating the outer conductors, having no jacket thereon, of the fine coaxial cables while sandwiching them from their upper and lower sides between the metal plates.

However, in the conventional connector, although the outer conductors of the fine coaxial cables are electrically connected and mechanically retained by the use of soldering, the solder does not stay within a range to be connected by the use of soldering, the solder does not stay within a range to be connected by the metal plates, for example, the ground bars, but is raised in a draw-out direction of the cables along the outer conductors so that bendability of the fine coaxial cables is degraded in a range where the solder is raised.

Actually, in the use after mounting in the connector, when the cables are forcibly bent in the foregoing range where the solder is raised, the outer conductors are broken.

Further, although the surfaces of the ground bars electrically contact metal outer members provided in the connector, because a flux is used in the soldering, connection failure is liable to occur. Metal plates can be used in place of the ground bars, but connection failure is liable to occur likewise because of using a flux in the soldering.

There is the problem that although, conventionally, the outer conductors of the coaxial cables are electrically connected and mechanically retained by the use of soldering, since wet solder goes along the outer conductors, the bendability of the coaxial cables is degraded in the range where the solder is raised. In order to solve this problem, the invention proposes a structure for connecting outer conductors of coaxial cables without using soldering.

SUMMARY OF THE INVENTION

It is therefore an object of this invention to provide a connector that does not degrade bendability of cables because of not using soldering of ground portions of the cables necessary for retaining the cables so that the cables can be readily bent even at their portions close to the connector.

It is another object of this invention to provide a connector that does not require a soldering process for ground portions of cables necessary for retaining the cables and that does not require a cleaning process because there is no occurrence of adhesion of an insulating material such as a flux used in the soldering, thereby enabling stable electrical contact.

It is still another object of this invention to provide a connector that can obtain a cable retaining force equivalent to a conventional one without using soldering of ground portions of cables.

According to the present invention, there is provided a connector for connecting to cables, which comprises a retaining member for aligning and retaining said cables. In the connector, the retaining member comprises a first retaining element and a second retaining element. The first retaining element has plural of fixing portions for retaining the cables therebetween and for fixedly retaining the second retaining element. The cables are sandwiched between the first retaining element and the second retaining element.

DESCRIPTION OF THE PREFERRED EMBODIMENT

In order to facilitate understanding of this invention, conventional connectors will be described prior to describing embodiments of this invention.

Figure 1:
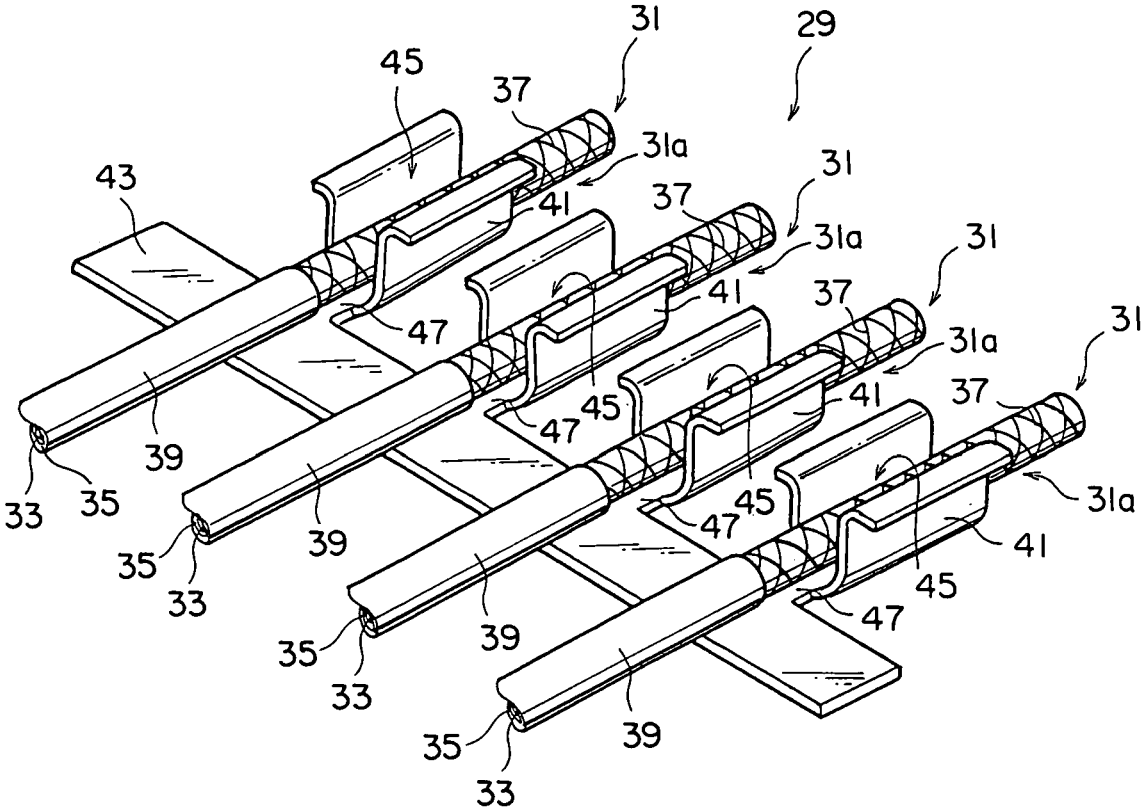
FIG. 1 PRIOR ART
FIG. 1 is a perspective view showing one example of a conventional coaxial cable connector.

Referring to FIG. 1, a conventional coaxial cable connector 29 disclosed in Patent Document 1 is adapted for electrical connection to outer conductors 37 of a plurality of coaxial cables 31 that are arranged in a row at a predetermined pitch. The coaxial cable connector 29 is configured such that terminals 41, each having a U-shape in cross-section and each for fittingly supporting a corresponding one of the outer conductors 37 of the coaxial cables 31 that are exposed by partly cutting off jackets 39 of the coaxial cables 31, are integrally arranged in a row and, by fitting engagement between the outer conductors 37 and the terminals 41, the outer conductors 37 and the terminals 41 are electrically connected together collectively. Alternatively, by heating the jackets 39 near connection portions or a terminal in-row arranging member 43, end portions 31*a* of the coaxial cables 31 arrayed horizontally at a predetermined pitch are respectively fitted in the corresponding terminals 41 without partly cutting the jackets 39. That is, the outer conductors 37 exposed from the melted jackets 39 contact the corresponding terminals 41 so that electrical connection therebetween is collectively achieved. In this manner, this conventional coaxial cable connector 29 has an advantage in that ground connection of the plurality of coaxial cables 31 can be achieved easily and, yet, reliably.

Figure 2:
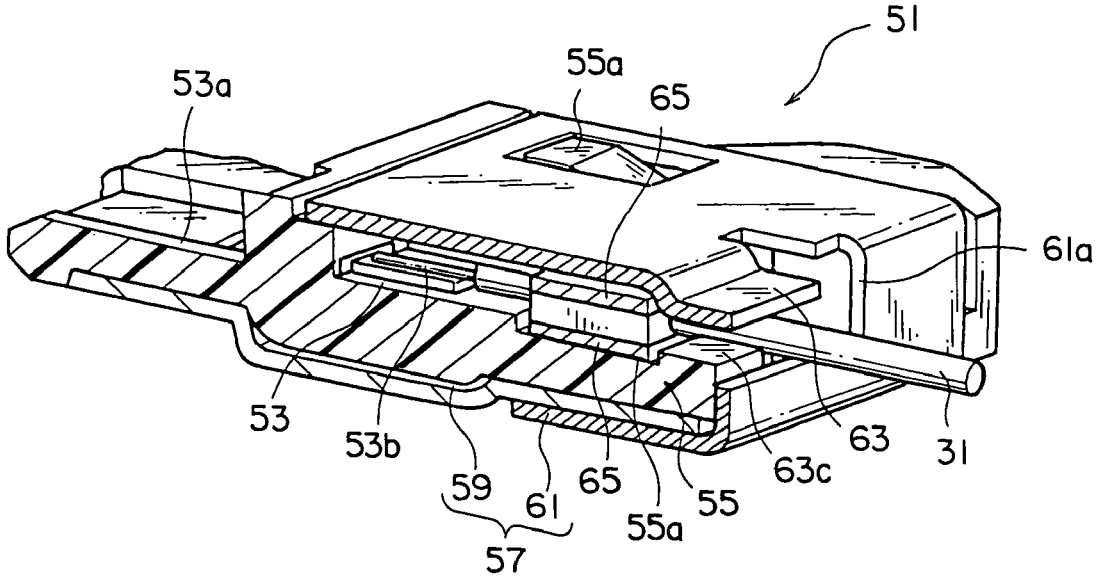
FIG. 2 PRIOR ART
FIG. 2 is a diagram showing a conventional cable connector according to another example.

On the other hand, referring to FIG. 2, a cable connector 51 described in Patent Document 2 is adapted for connection to fine coaxial type cables 31 in the form of plural fine coaxial cables 31 put together. The cable connector 51 comprises a number of conductive contacts 53 arrayed laterally in a row for connection to center conductors or core wires 33 of the fine coaxial cables 31, an insulator 55 fixedly retaining the contacts 53, and a shell 57 covering the insulator 55. The contacts 53 are fixed to the insulator 55 by press-fitting.

The shell 57 comprises a first shell member 59 made of metal and fixedly retained by the insulator 55, and a second shell member 61 made of metal and retained by the insulator 55 so as to be attachable/detachable following forward/backward sliding. The first shell member 59 covers a lower surface of the insulator 55 so as to correspond to contact portions 53*a* of the contacts 53. The second shell member 61 is fitted over a relatively rear part of the insulator 55 and has a retaining portion 63 for retaining coated portions 39 of the coaxial cables 31 cooperatively with the insulator 55 in a sandwich manner. The second shell member 61 is in contact with an outer surface of the first shell member 59.

Figure 3:
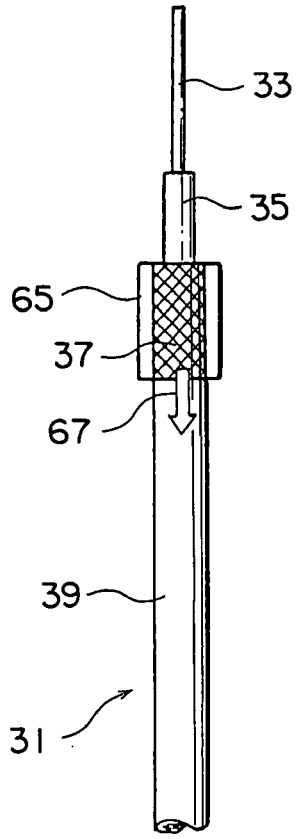
FIG. 3 PRIOR ART
FIG. 3 is a side view showing the state where a coaxial cable is provided with ground bars.

Referring to FIG. 3, the plurality of coaxial cables 31 are arranged in a planar fashion while partly exposing the outer conductors (shield wires) 37, then the exposed portions of the outer conductors 37 are sandwiched between a pair of metal ground bars 65, and soldering is carried out while heating them, thereby electrically connecting the outer conductors 37 to the ground bars 65 collectively. In this event, the state of the planar arrangement of the plurality of fine coaxial cables 31 is maintained. The center conductor 33 is exposed at the tip of each fine coaxial cable 31.

In order to connect the fine coaxial cables 31 applied with the foregoing treatment to the connector 51, the second shell member 61 is first detached from the insulator 55 and the coaxial cables 31 along with the ground bars 65 are passed through an opening 61*a* of the second shell member 61.

Then, the ground bars 65 are disposed in a recessed portion 55*a* of the insulator 55 so that the center conductors 33 of the coaxial cables 31 are placed on connection portions 53*b* of the contacts 53 and soldered thereto. Further, the second shell member 61 is fitted over the insulator 55 and brought into contact with the first shell member 59, thereby obtaining the structure shown in FIG. 2. In this state, the second shell member 61 is locked by engagement projections 55*b* of the insulator 55. As a result, the ground bars 65 are retained in the recessed portion 55*a* by the insulator 55 and the second shell member 61, and the retaining portion 63 of the second shell member 61 cooperates with a corresponding portion 55*c* of the insulator 55 to thereby retain the coated portions 39 of the fine coaxial cables 31 therebetween in the sandwich manner.

As described above, in the conventional connector, the soldering is implemented by heating the outer conductors 37, having no jacket thereon, of the fine coaxial cables 31 while sandwiching them from their upper and lower sides between the metal plates.

However, in the conventional connector, although the outer conductors 37 of the fine coaxial cables 31 are electrically connected and mechanically retained by the use of soldering, the solder does not stay within a range to be connected by the metal plates, for example, the ground bars 65, but is raised in a draw-out direction of the cables 31 along the outer conductors 37 as shown by a void arrow 67 in FIG. 3 so that bendability of the fine coaxial cables 31 is degraded in a range where the solder is raised.

Actually, in the use after mounting in the connector, when the cables are forcibly bent in the foregoing range where the solder is raised, the outer conductors 37 are broken.

Further, although the surface of the ground bar 65 electrically contacts the metal outer member provided in the connector, because a flux is used in the soldering, connection failure is liable to occur. Metal plates can be used in place of the ground bars, but connection failure is liable to occur likewise because of using a flux in the soldering.

There is the problem that although, conventionally, the outer conductors of the coaxial cables are electrically connected and mechanically retained by the use of soldering, since wet solder goes along the outer conductors, the bendability of the coaxial cables is degraded in the range where the solder is raised.

Now, the embodiments of this invention will be described with reference to the drawings.

Figure 4:
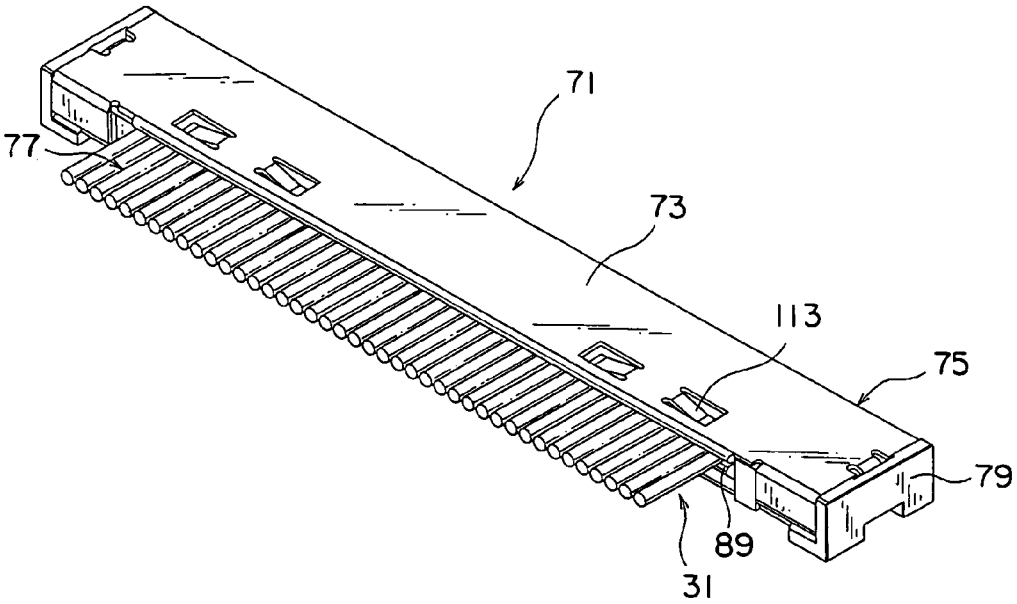
FIG. 4 is a perspective view of a connector according to a first embodiment of this invention.
Figure 5:
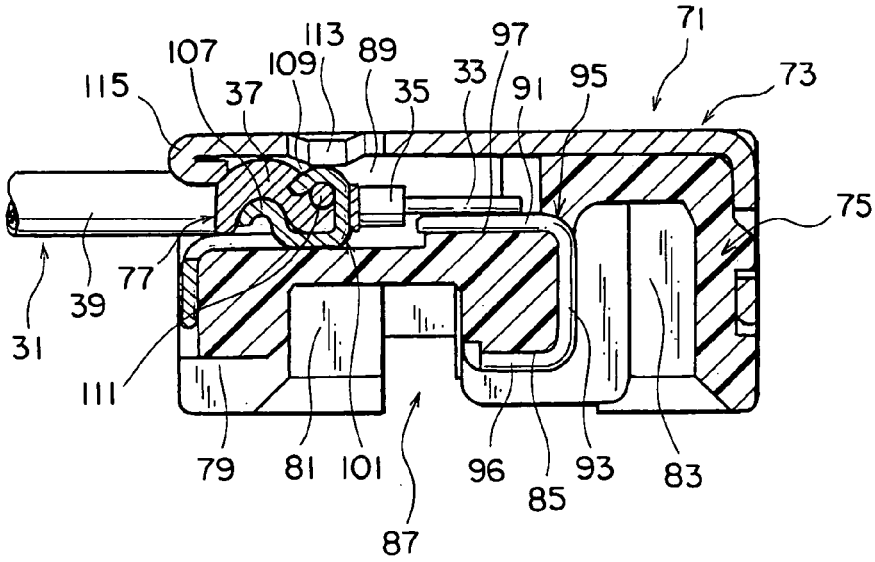
FIG. 5 is a sectional view of the connector shown in FIG. 4.
Figure 6:
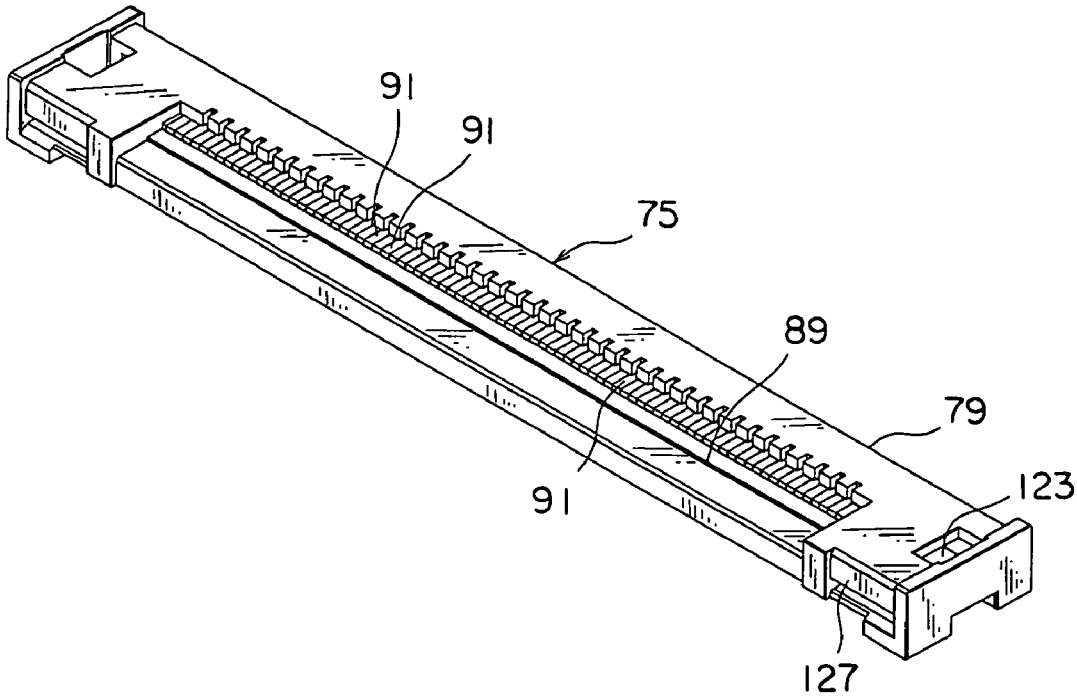
FIG. 6 is a perspective view showing a connector body shown in FIG. 4.

Referring to FIGS. 4 to 6, a connector 71 according to a first embodiment of this invention comprises a metal shell 73 being a metal outer member, a connector body 75, and a cable line-up member 77. In the following description, similar parts being described will be represented by similar reference numerals.

As best shown in FIG. 5, the connector body 75 comprises an insulator 79. The insulator 79 is provided on its side, i.e. at a lower end in FIG. 5, with a fitting portion 87 for receiving therein a counterpart connector. The fitting portion 87 has recessed portions 81 and 83 and a projected stripe portion 85 therebetween. Further, on the other side, the insulator 79 has a cable receiving portion 89 for receiving therein one end of the cable line-up member 77. The insulator 79 is provided with contacts 95 each having a U-shape in section and each comprising a cable contacting portion 91, a contact contacting portion 93, and a tip end portion 96 that are formed integral with each other. Each contact 95 is retained by the insulator 79 by the use of its U-shape in section.

The cable receiving portion 89 is formed with grooves 97 each extending, horizontally in FIG. 5, into the recessed portion 83 of the fitting portion 87 adapted to receive therein the counterpart connector. The cable contacting portion 91 of each contact 95 is mounted in the corresponding groove 97.

Figure 7:
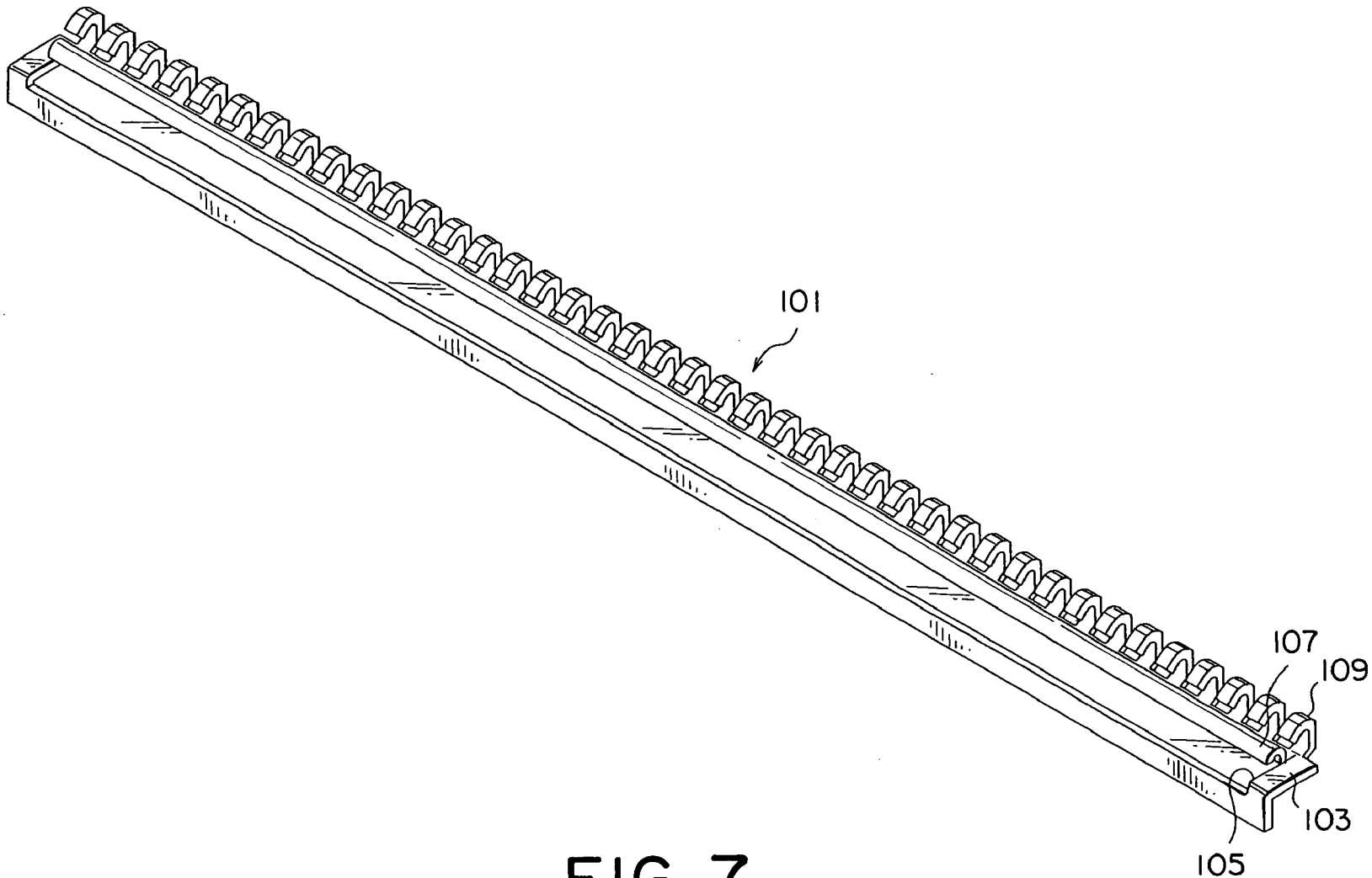
FIG. 7 is a perspective view showing a metal plate of a cable line-up member of the connector shown in FIG. 4.

Referring to FIG. 7, a metal plate 101, serving as a first retaining element, comprises a body 103 having an L-shape in section, a convex portion or support portion 107 that is bent without slitting so as to form an opening portion 105 in the body 103 and protrudes upward, and presser pawls 109 each bent forward and serving as a fixing portion for a metal round bar 111. The presser pawls 109 are arranged at constant-pitch intervals in a width direction of the connector. It may also be configured that a protrudent support portion 107 is provided without forming the opening portion 105.

Figure 8:
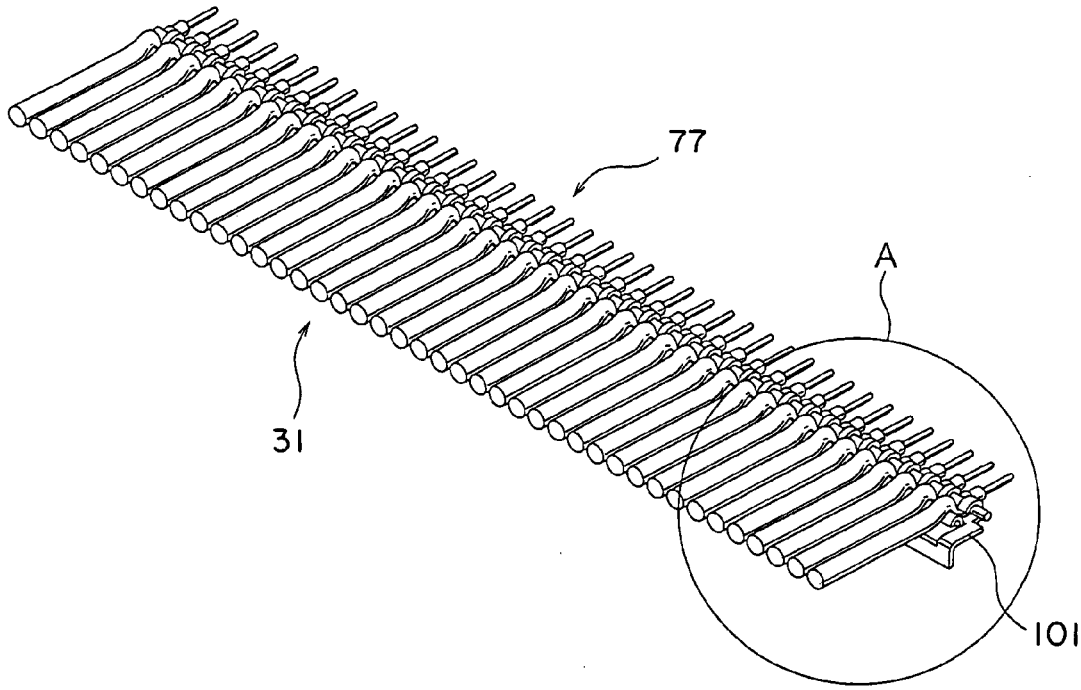
FIG. 8 is a perspective view showing the cable line-up member.
Figure 9:
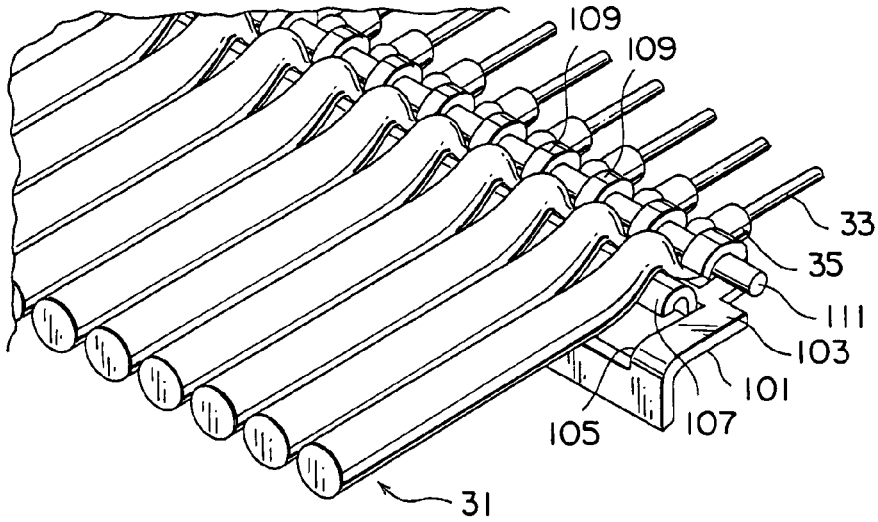
FIG. 9 is an enlarged perspective view of a portion A of the cable line-up member shown in FIG. 8.

As shown in FIGS. 8 and 9, each of the fine coaxial cables 31 comprises the center conductor 33, the insulating portion 35 around the center conductor 33, the outer conductor 37 around the insulating portion 35, and the jacket 39 covering around the outer conductor 37. Near one end of the fine coaxial cables 31, the outer conductors 37 are sandwiched between the adjacent presser pawls 109 of the metal plate 101 and slightly squashed. In this state, the metal round bar 111, serving as a second retaining element, is inserted in the width direction so as to press the outer conductors 37 by the presser pawls 109 in the state where the fine coaxial cables 31 are aligned and, accordingly, the tip end portions of the coaxial cables 31 are aligned on the support portion 107 of the metal plate 101. Consequently, the coaxial cables 31 are mechanically retained by the metal plate 101 while the metal plate 101 and the outer conductors 37 of the coaxial cables 31 are electrically connected together, thereby forming the cable line-up member 77 as best shown in FIG. 5 where each outer conductor 37 is fixedly retained in a meandering or zigzag fashion. By fixedly retaining the fine coaxial cables 31 in the zigzag fashion, the cable retaining force is enhanced.

Figure 10:
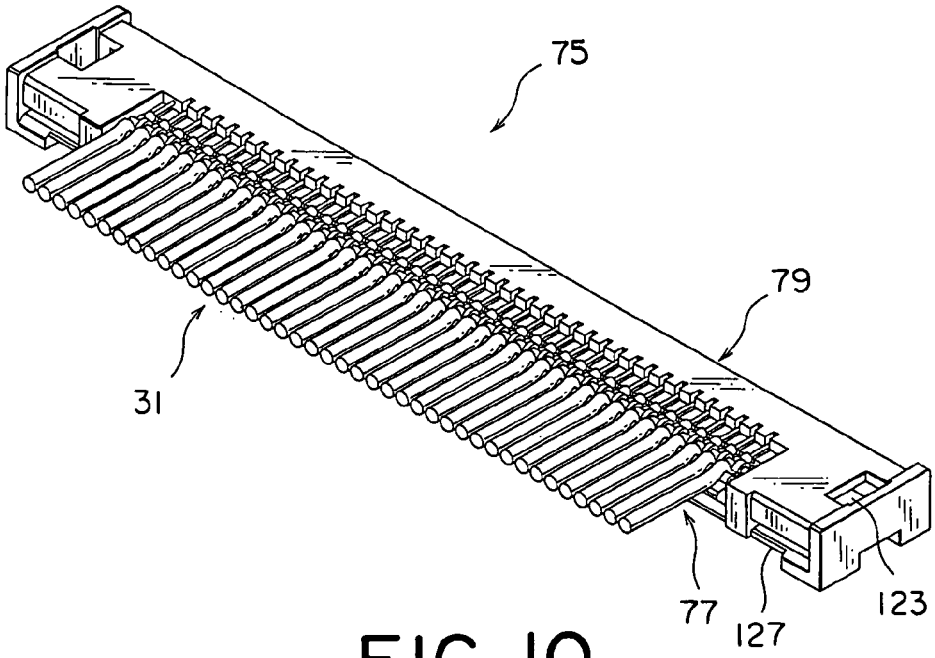
FIG. 10 is a perspective view showing the state where the cable line-up member shown in FIG. 8 is incorporated in the connector body shown in FIG. 6.

When the cable line-up member 77 shown in FIGS. 8 and 9 is mounted in the cable receiving portion 89 of the connector body 75 shown in FIG. 6, a state shown in FIG. 10 is obtained. Herein, as shown in FIG. 5, the cable contacting portion 91 of each contact 95 in the groove 97 and the center conductor 33 of the corresponding coaxial cable 31 are fixed together by soldering. However, since the coaxial cables 31 are mounted to the connector body 75 along with the metal plate 101, the center conductors 33 may be merely placed in contact with the cable contacting portions 91 of the contacts 95 without soldering. In this invention, since the metal plate 101 and the metal round bar 111 cooperatively serve to align and retain the fine coaxial cables 31, they are collectively called a cable retaining member wherein the metal plate 101 is called a first retaining element or a body portion of the cable retaining member, while the metal round bar 111 is called a second retaining element or a bar-shaped member of the cable retaining member. Further, the presser pawls 109 of the metal plate 101 are each called a fixing portion.

Figure 11:
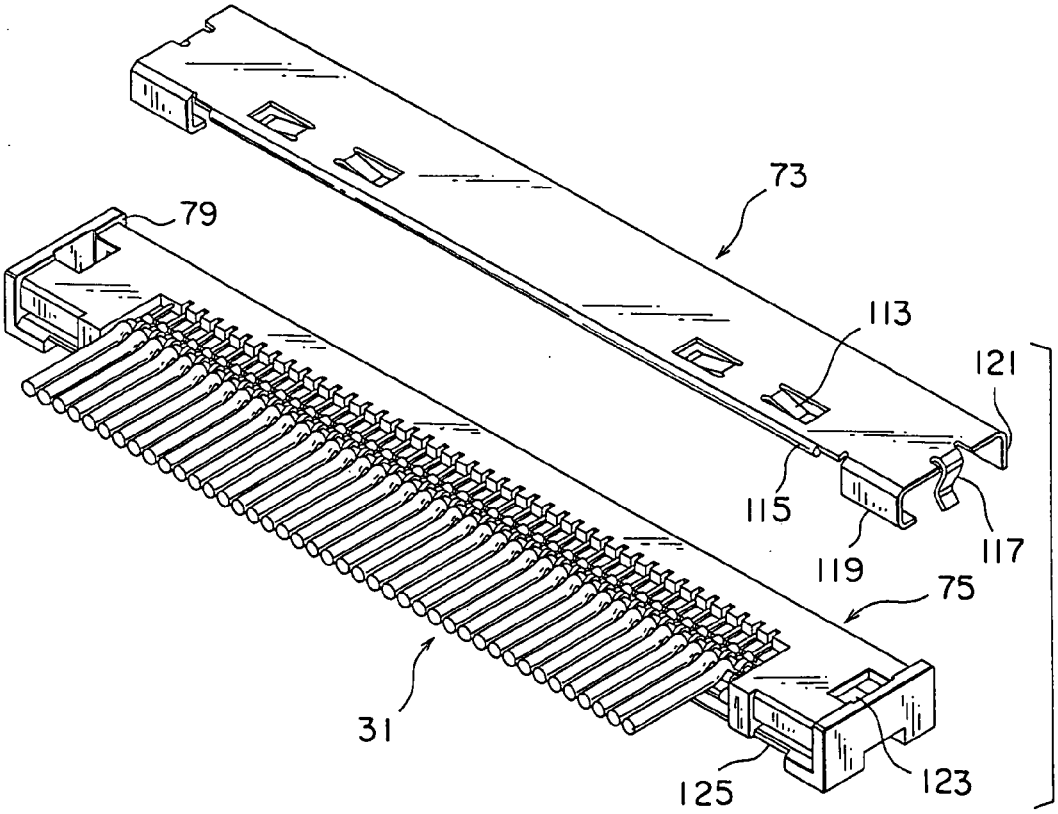
FIG. 11 is a perspective view for use in explaining mounting of a metal outer member onto the connector body mounted with the cable line-up member as shown in FIG. 10.

As shown in FIG. 11, the metal shell 73, as the metal outer member, is mounted on the connector body 75 mounted with the cable line-up member 77 in the state as shown in FIG. 10. The metal shell 73 is a pressed product formed from a metal plate. The metal shell 73 is reinforced by folding back an end portion 115 and has spring strips 113 formed by cutting portions of the flat plate on the front side, L-shaped engaging pawls 117 on both sides, L-shaped mounting strips 119 on the front side at both sides, and abutting strips 121 on the rear side at both sides. On the other hand, the insulator 79 is provided near its both sides with engaging holes 123 for engagement with the engaging pawls 117 of the metal shell 73 and at its front end with recessed mounting portions 125 for enabling mounting of the mounting strips 119 thereto. When the engaging pawls 117 and the mounting strips 119 are mounted to the engaging holes 123 and the mounting portions 125, the connector 71 shown in FIG. 4 is completed.

As shown in FIG. 5, the metal plate 101 of the cable line-up member 77 is in tight contact with a bottom surface of the cable receiving portion 89, the presser pawls 109 are pressed at their upper portions by the plate springs 113 of the metal shell 73, and further, the metal shell 73 is folded back to form double layers at its front end, and therefore, it is possible to sufficiently resist a force in the cable draw-out direction.

A connector 127 according to a second embodiment of this invention shown in FIG. 12 has the same structure as that of the connector 71 according to the first embodiment of this invention as described with reference to FIG. 5 and so on, except that an end portion, on the side of a cable receiving portion 89, of a metal shell 73 extends downward to form a presser strip 128. Therefore, in the connector 127 according to the second embodiment, the amplitude of the zigzag shape increases as compared with that in the connector 71 according to the first embodiment so that the fine coaxial cables 31 are more reluctant to come off. The other effects are the same as those in the first embodiment.

Aligned fine coaxial cables 31 are set between the presser pawls 109 of the metal plate 101 and then a metal round bar 111 is passed in a pitch direction so as to be pressed by the presser pawls 109. By pressing the fine coaxial cables 31 by the use of the metal round bar 111, zigzag portions of the coaxial cables 31 are squashed so as to be retained by the metal plate 101. The metal plate 101 is provided with a support portion 107 being a protrudent stripe portion that extends in the pitch direction. A cable retaining force is obtained in the state where the coaxial cables 31 are set in the connector while meandering.

In the connector according to each of the foregoing first and second embodiments of this invention, the fine coaxial cables 31 are used as cables. However, it is, of course, possible to use coaxial cables, electrical wires, flexible flat cables (FFC), flexible printed circuits (FPC), or flexible ribbon cables (FRC) in this invention as long as mounting portions are independent of each other at conductor portions thereof.

In the first and second embodiments of this invention, the round bar 111 is used as the bar-shaped member. However, the bar-shaped member may also have an elliptical shape or a polygonal shape such as a rectangular or hexagonal shape in cross-section.

Now, description will be given of a counterpart connector that is fitted to the connector according to each of the first and second embodiments of this invention. Herein, for the sake of description, a portion where terminal portions 129 of contacts are projected is called the front of the connector and the opposite side is called the back of the connector.

Figure 13A:
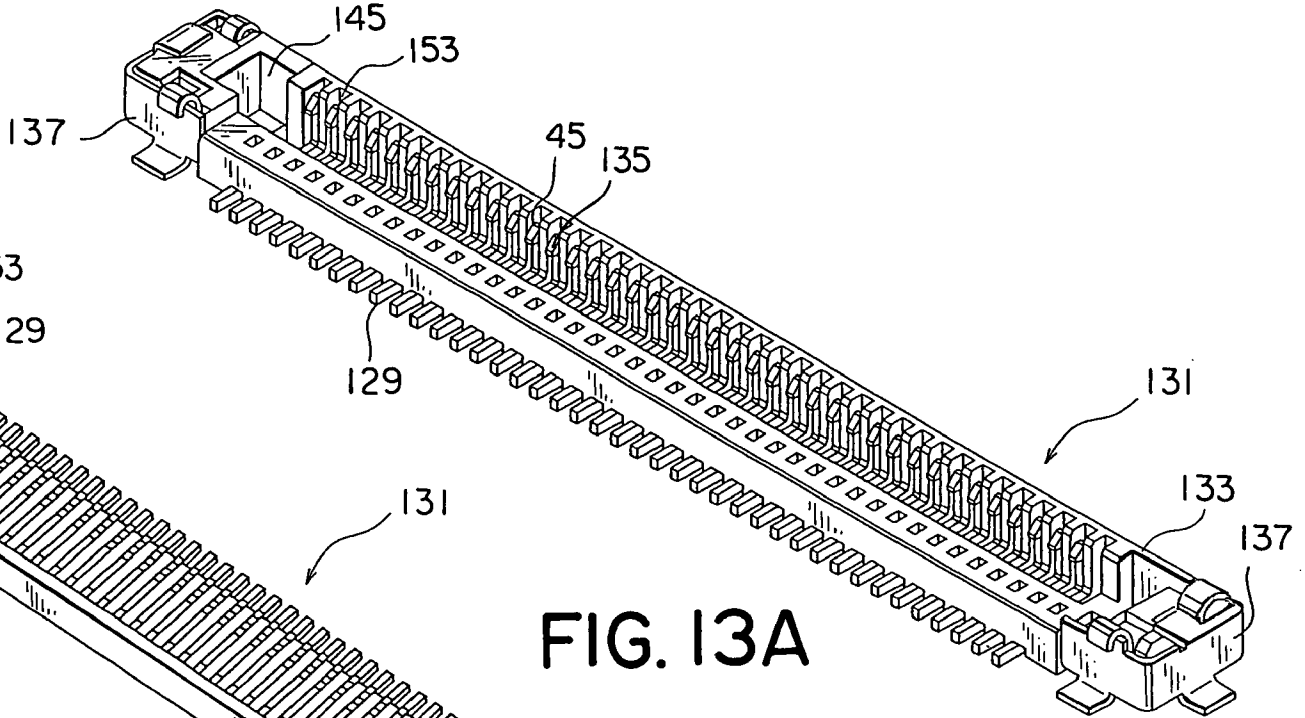
FIG. 13A is a perspective view showing a counterpart connector that is fitted to the connector according to the first or second embodiment of this invention, wherein the side opposite to the board mounting side is shown.
Figure 13B:
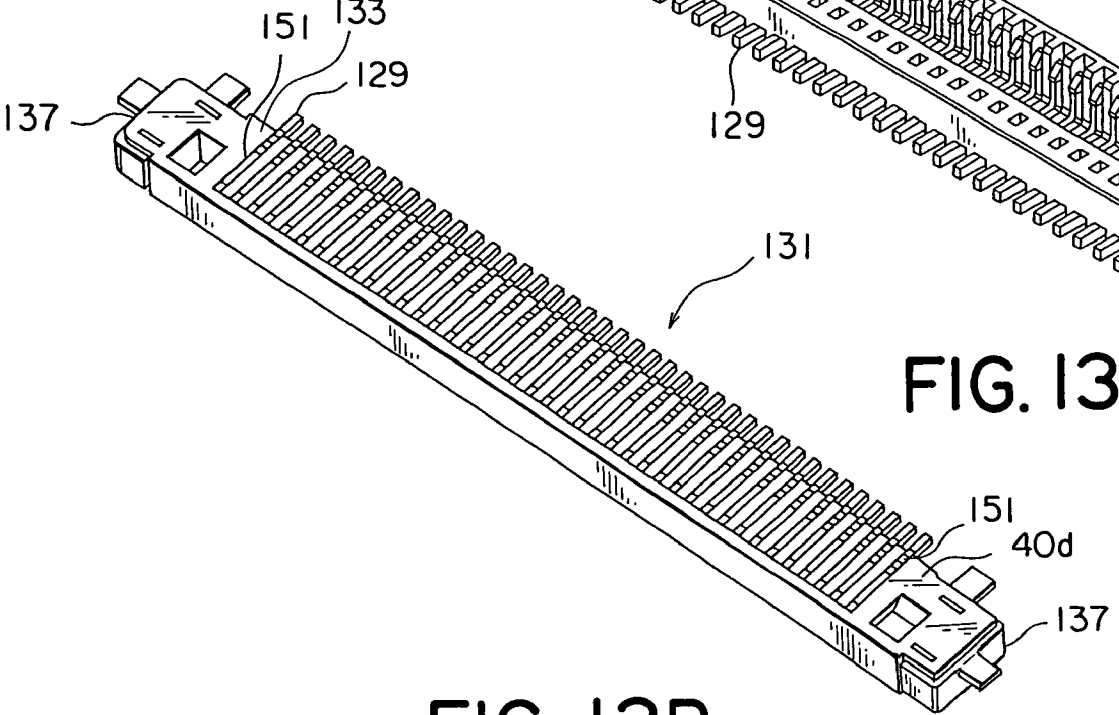
FIG. 13B is a perspective view, as seen from the board mounting side, showing the counterpart connector that is fitted to the connector according to the first or second embodiment of this invention.
Figure 14:
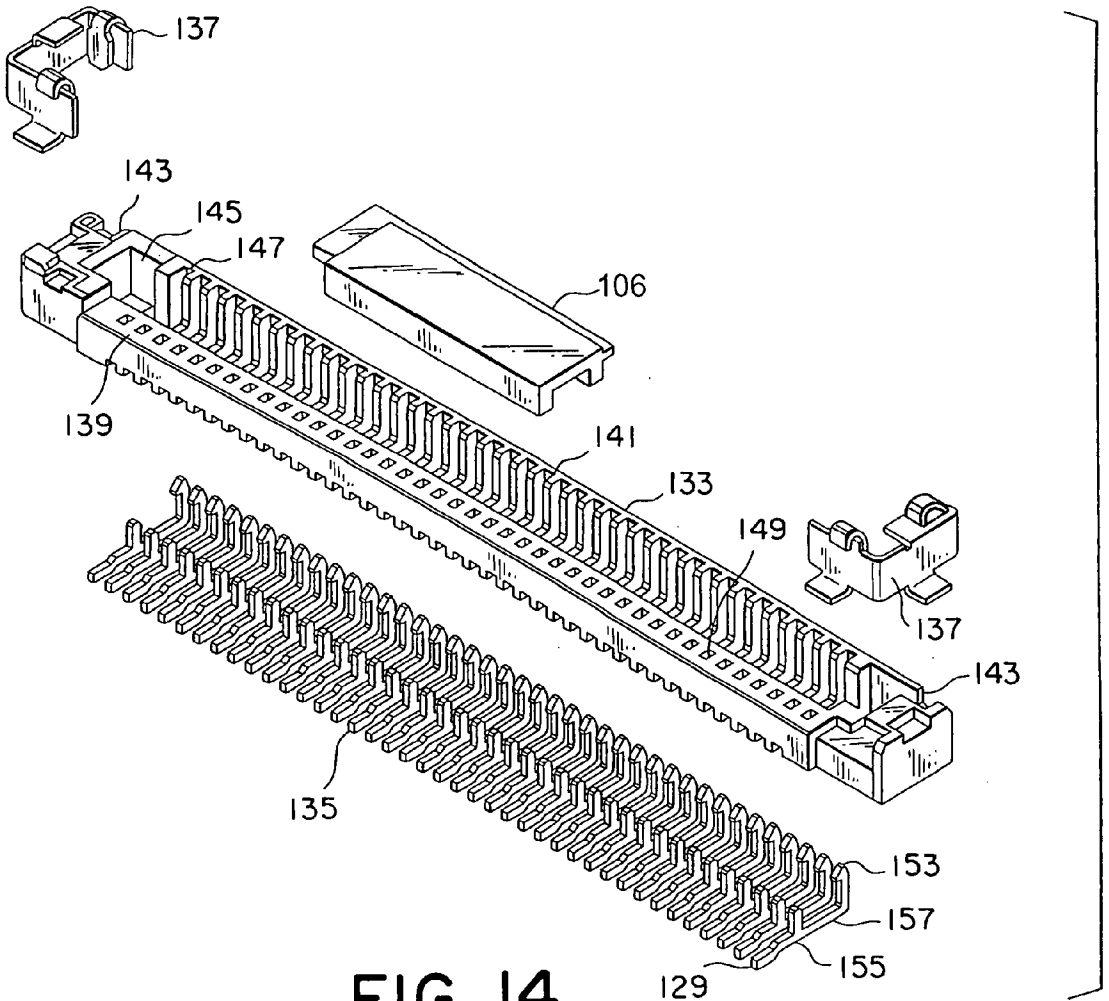
FIG. 14 is an exploded perspective view of the counterpart connector shown in FIGS. 13A and 13B.

Referring to FIGS. 13A, 13B, and 14, a counterpart connector 131 comprises a box-shaped insulator 133, plural of counterpart contacts 135 press-fitted to the insulator 133, and holddowns 137 in the form of U-shaped metal fittings for mounting to a circuit board or the like. The insulator 133 comprises a front wall 139, a rear wall 141, and both side walls 143 and has a generally square-shape with an opening 145 at the center formed by the walls 139,141, and 143. Grooves 147 are formed on an inner surface of the rear wall 141. The grooves 147 each extend longitudinally and are arranged at a constant pitch in a width direction. Further, the front wall 139 is formed with through holes 149 each vertically passing through a center portion, in a forward/backward direction, of the front wall 139 and arranged at the same pitch as that of the grooves 147 and at the same positions as those of the grooves 147 in the width direction. Further, grooves 151 are formed on a bottom surface of the insulator 133 so as to pass lower ends of the corresponding grooves 147 and through holes 149. The grooves 151 each extend in the forward/backward direction and are arranged in the width direction at the same pitch as that of the grooves 147 or the through holes 149.

Each of counterpart contact 135 has a generally F-shape and comprises a contact contacting portion 153, a press-fitting portion 155, a joining portion 157 joining together one end of the contact contacting portion 153 and one end of the press-fitting portion 155, and a terminal portion 129 extending further forward from the joining portion 157. Each counterpart contact 135 is mounted such that the contact contacting portion 153 and the press-fitting portion 155 are press-fitted into the groove 147 and the hole 149, respectively, from the bottom surface side in FIG. 14 while the joining portion 157 and the terminal portion 129 are received in the groove 151.

The holddowns 137 each have a generally U-shape and are attached to both sides of the insulator 133, respectively. The counterpart connector 131 is mounted on a board such as a printed board and used by fixing the terminal portions 129 by soldering.

Figure 12:
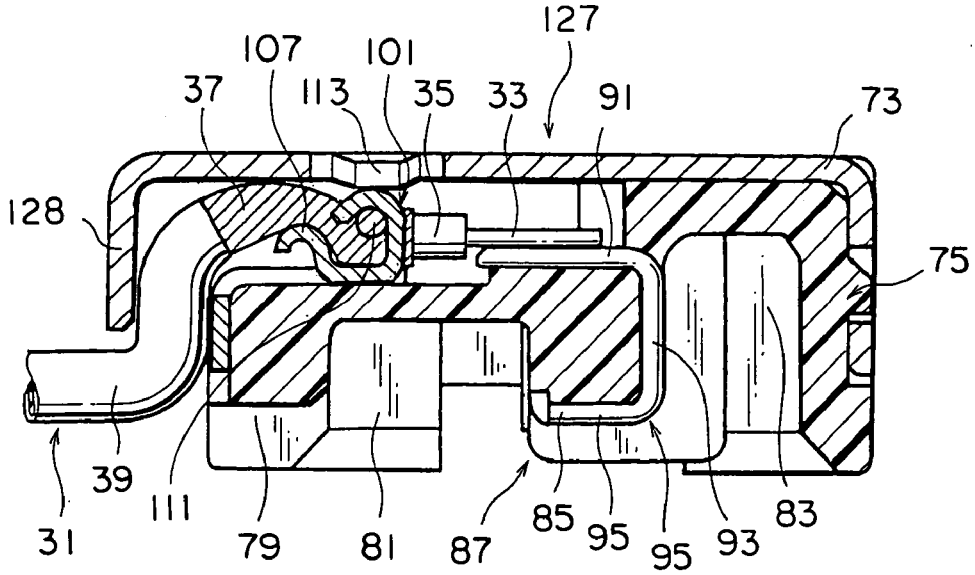
FIG. 12 is a sectional view of a connector according to a second embodiment of this invention.

When the projected stripe portion 85 at the center of the fitting portion 87 of the connector shown in FIG. 5 or 12 is fitted into the opening 145, the contact contacting portions 93 of the contacts 95 of the connector and the contact contacting portions 153 of the counterpart contacts 135 are brought into contact with each other so that electrical connection is established.

A separate adsorption member shown in FIG. 14 is a component that is adsorbed to an adsorption nozzle in automatic mounting and is detachably mounted to the counterpart connector 131.

The description has been given of the connectors 71 and 127 each adapted for fitting to the counterpart connector 131. However, it is readily understood that the connector having the cable line-up member 77 of this invention is not limited to the connectors according to the foregoing embodiments and may also be a connector, for example, having a cable connecting portion or a board connecting portion on a side which is different from the cable line-up member receiving side.

Figure 15:
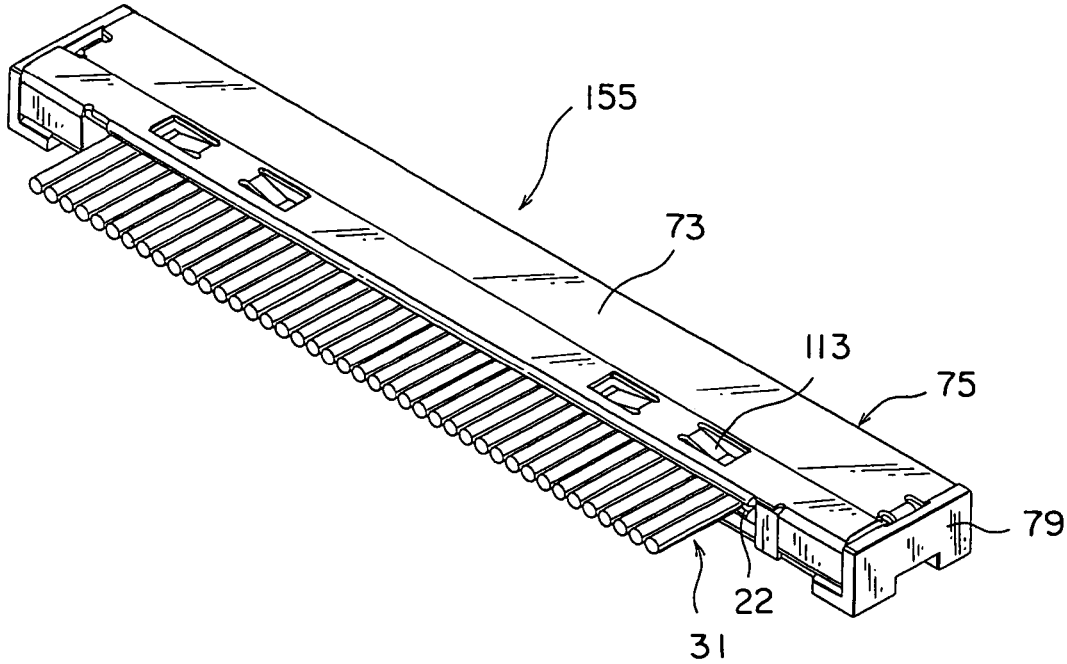
FIG. 15 is a perspective view of a connector according to a third embodiment of this invention.
Figure 16:
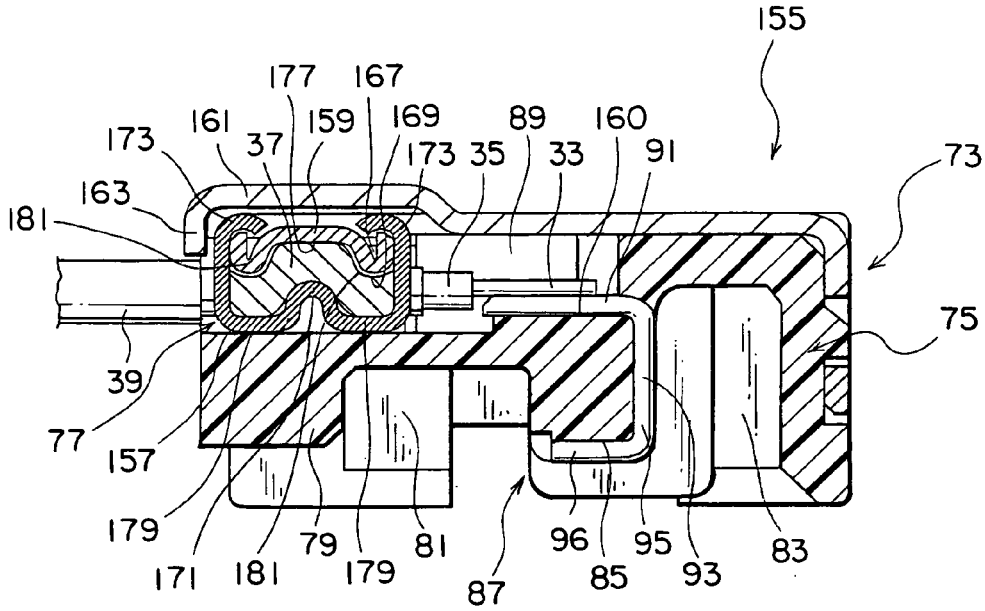
FIG. 16 is a sectional view of the connector shown in FIG. 15.

FIG. 15 is a perspective view of a connector according to a third embodiment of this invention. FIG. 16 is a sectional view of the connector shown in FIG. 15.

Referring to FIGS. 15 and 16, a connector 155 comprises the metal shell 73 being a metal outer member, the connector body 75, and the cable line-up member 77 having a lower metal plate 157 and an upper metal plate 159.

As best shown in FIG. 16, the connector body 75 comprises the insulator 79. The insulator 79 is provided on its side, i.e. at a lower end in FIG. 16, with the fitting portion 87 for receiving therein a counterpart connector. The fitting portion 87 has recessed portions 81 and 83 and the projected stripe portion 85 therebetween. Further, on the other side, the insulator 79 has the cable receiving portion 89 for receiving therein one end of the cable line-up member 77. The insulator 79 is provided with contacts 95 each having a U-shape in section and each comprising the cable contacting portion 91, the contact contacting portion 93, and the tip end portion 96 that are formed integral with each other. Each contact 95 is retained by the insulator 79 by the use of its U-shape in section.

The cable receiving portion 89 is formed with grooves 160 each extending, horizontally in FIG. 16, into the recessed portion 83 of the fitting portion 87 adapted to receive therein the counterpart connector. The cable contacting portion 91 of each contact 95 is mounted in the corresponding groove 160.

The shell 73 is formed with a platform 161 raised in a stepped fashion on an opening side. The platform 161 has a front end bent vertically to form a presser strip 163 on the front side. The presser strip 163 is shorter in vertical length than the presser strip 130 in the second embodiment but still has the same effect of preventing the cable line-up member 77 from coming off as described before.

Figures 17A, 17B, 17C:
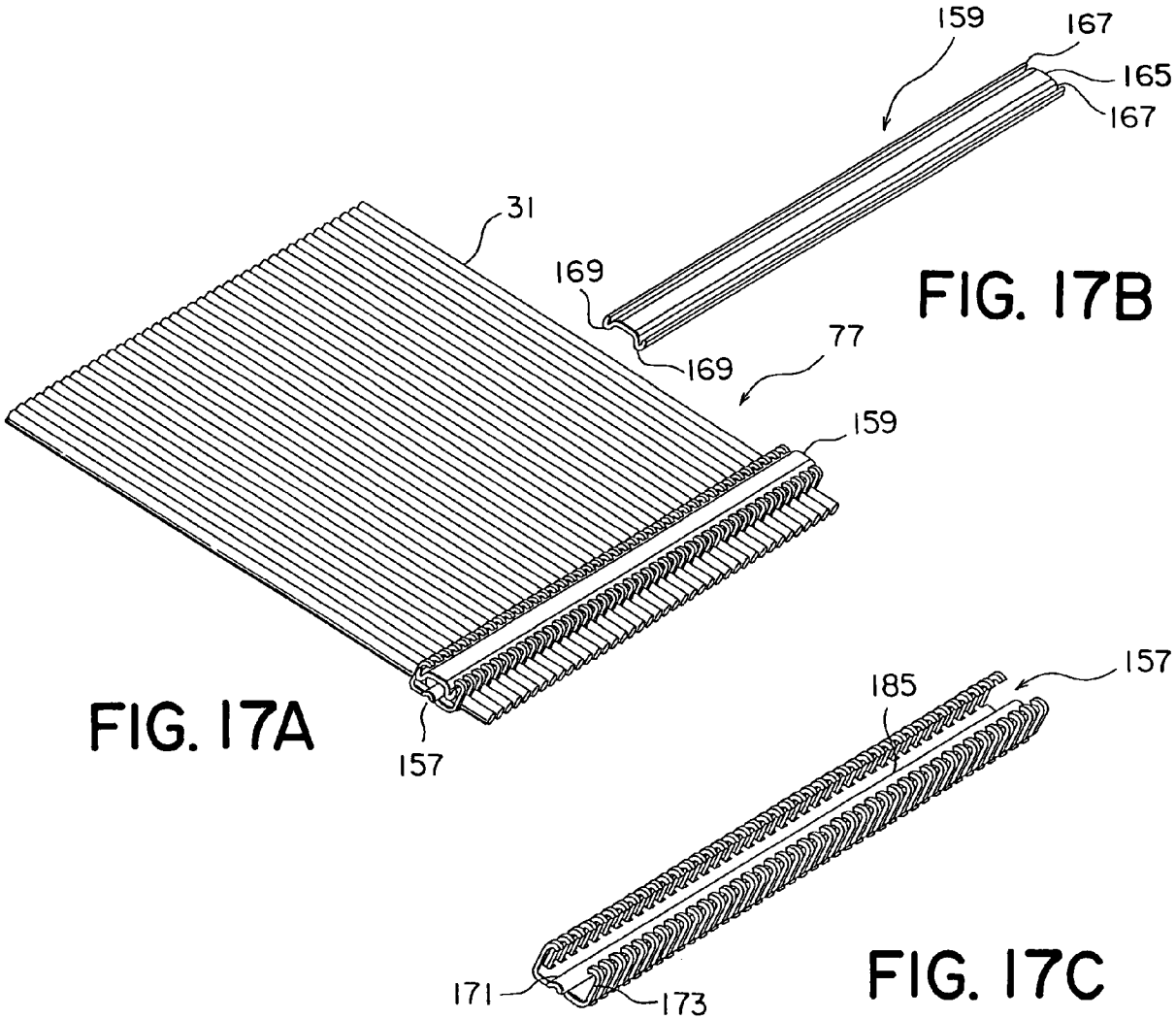
FIG. 17A is a perspective view showing a cable line-up member of the connector shown in FIG. 16.
FIG. 17B is a perspective view showing an upper metal plate of the cable line-up member of the connector shown in FIG. 16.
FIG. 17C is a perspective view showing a lower metal plate of the cable line-up member of the connector shown in FIG. 16.

Referring to FIG. 17A, the cable line-up member 77 comprises the lower metal plate 157, the upper metal plate 159, and fine coaxial cables 31 sandwiched between the lower metal plate 157 and the upper lower plate 159. Herein, the lower metal plate 157 and the upper metal plate 159 are collectively called a cable retaining member wherein the lower metal plate 157 is called a first retaining element and the upper metal plate 159 is called a second retaining element.

In the illustrated example, each of the fine coaxial cable 31 has one end portion where the jacket 39 is removed for exposing the outer conductor 37. The insulating portion 35 and a center conductor 33 are not exposed. It may be configured such that, after the cable line-up member 77 is formed, the outer conductor 37 and the insulating portion 35 are removed in turn at a tip end portion extending further from a portion of the coaxial cable 31 that is retained in a sandwich manner, thereby exposing the center conductor 33 as shown in FIG. 16.

As shown in FIG. 17B, the upper metal plate 159 comprises a ceiling portion 165 and grooves 167 provided on both sides thereof and each extending over the length of the ceiling portion 165. With the formation of the grooves 167, the upper metal plate 159 is in the form of a metal plate having projected portions 169 on the back side and having a trapezoidal shape in cross-section.

As shown in FIG. 17C, the lower metal plate 157 comprises a protrudent portion 171 in the form of a projected stripe provided at the center and extending over the length of the lower metal plate 157. The lower metal plate 157 further comprises a plurality of presser pawls 173 provided on both sides of the protrudent portion 171. The presser pawls 173 are arranged in the length direction on each side of the protrudent portion 171 at a constant pitch. The presser pawls 173 each have an inverted L-shape and have tip end portions confronting each other. The lower metal plate 157 further comprises bottom portions 179 provided on both sides of the protrudent portion 171 and each connecting between the presser pawls 173. The protrudent portion 171 serves as a cable support portion while the presser pawls 173 serve as fixing portions for fixing the upper metal plate 159.

Referring to FIG. 17A and also FIG. 16, each of the fine coaxial cables 31 comprises the center conductor 33, the insulating portion 35 around the center conductor 33, the outer conductor 37 around the insulating portion 35, and the jacket 39 covering around the outer conductor 37. Near one end of the fine coaxial cables 31, the outer conductors 37 are sandwiched between the adjacent presser pawls 173 of the lower metal plate 157 and slightly squashed. In this state, the upper metal plate 159 is mounted while passing under the presser pawls 173. In this event, the tip ends of the presser pawls 173 engage with the grooves 167 formed on the upper side of the upper metal pate 159 on both sides thereof so that the upper metal plate 159 slidingly moves in the length direction and is retained in the state as shown in FIG. 17A. In this state, the outer conductors 37 are mechanically retained between the protrudent portion 171 and the projected portions 169 so that the lower and upper metal plates 157 and 159 and the outer conductors 37 of the coaxial cables 31 are electrically connected together. Accordingly, the cable line-up member 77 is formed as best shown in FIG. 16 where each the outer conductor 37 is fixedly retained in a meandering or zigzag fashion. By fixedly retaining the fine coaxial cables 31 in the zigzag fashion, the cable retaining force is enhanced.

When the cable line-up member 77 shown in FIG. 17A is mounted in the cable receiving portion 89 of the connector body 75 shown in FIG. 16, a state shown in FIG. 15 is obtained. Herein, as shown in FIG. 16, the cable contacting portion 91 of each contact 95 in the groove 159 and the center conductor 33 of the corresponding coaxial cable 31 are fixed together by soldering. However, since the coaxial cables 31 are mounted to the connector body 75 along with the lower and upper metal plates 157 and 159, the center conductors 33 may be merely placed in contact with the cable contacting portions 91 of the contacts 95 without soldering.

In this invention, since the lower and upper metal plates 157 and 159 cooperatively serve to align and retain the fine coaxial cables 31, they are collectively called a cable retaining member. Further, the presser pawls 173 of the lower metal plate 157 are each called a fixing portion.

Figure 18:
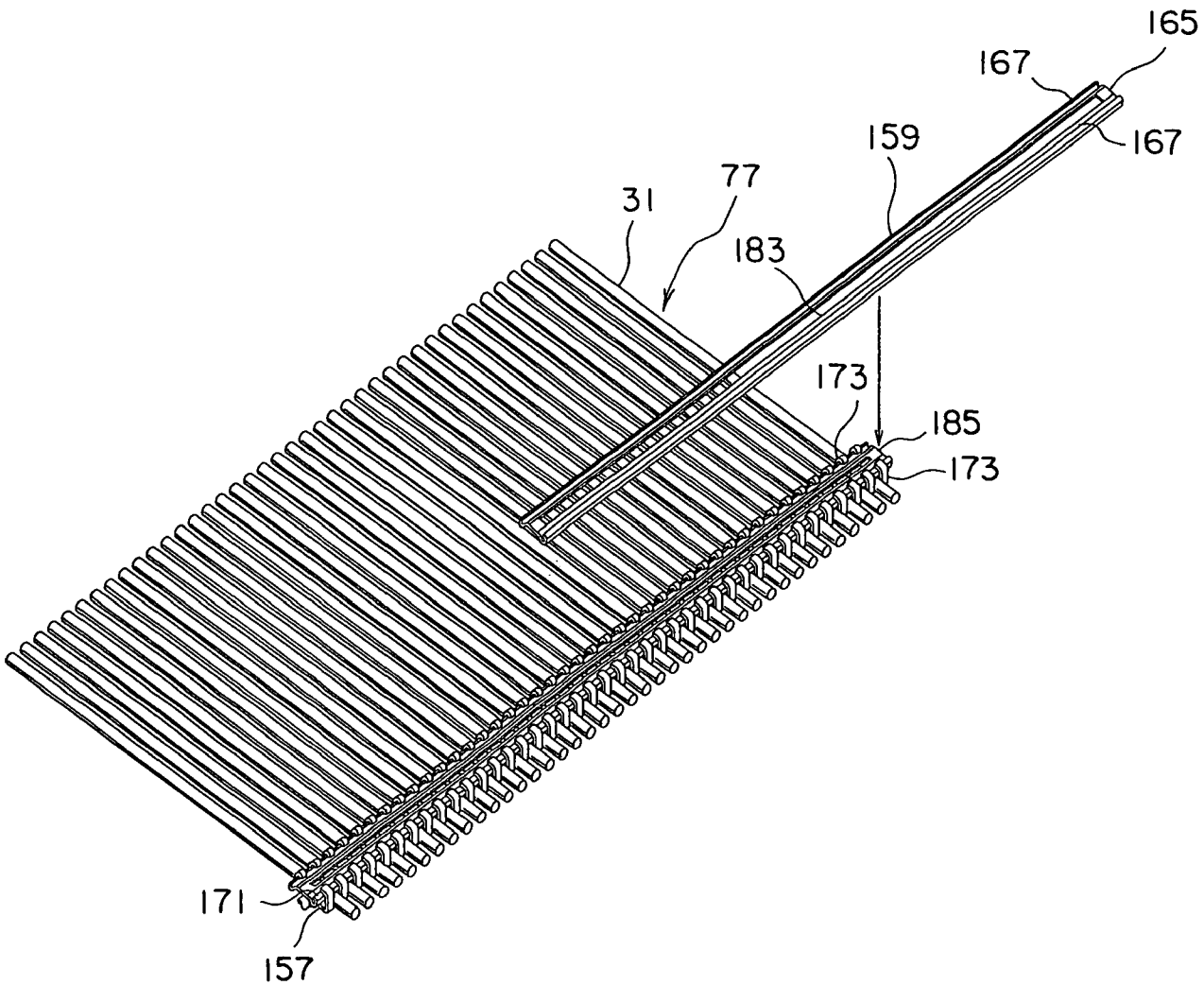
FIG. 18 is a perspective view showing a cable line-up member according to a fourth embodiment of this invention which is a modification of the cable line-up member of the connector shown in FIG. 16.
Figure 19A:
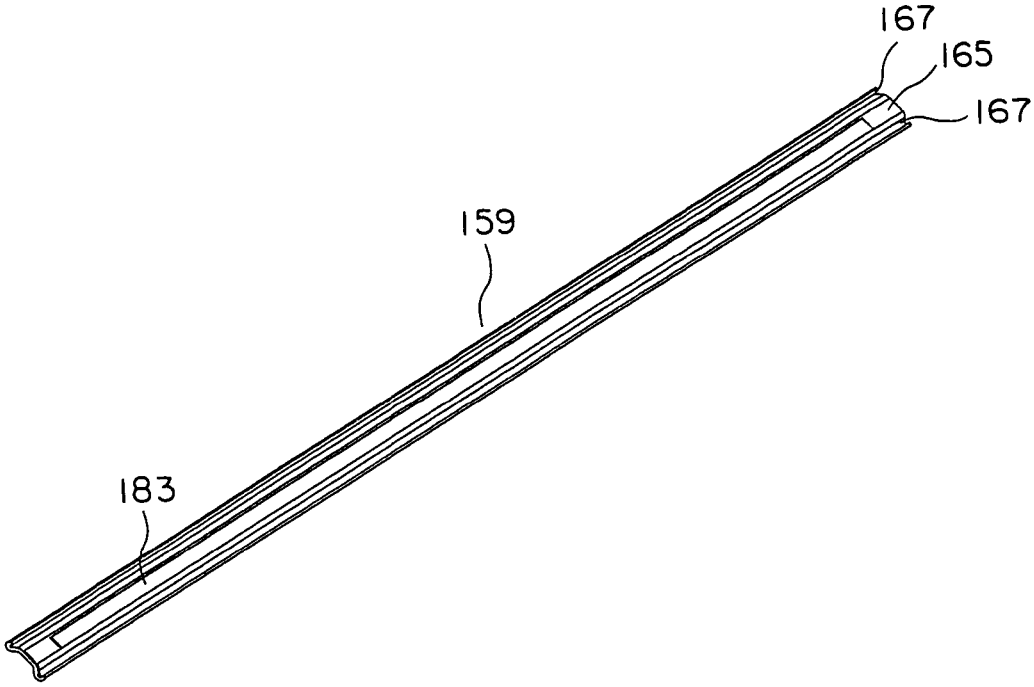
FIG. 19A is a perspective view showing an upper metal plate of the cable line-up member shown in FIG. 18.

Referring to FIGS. 18 and 19A, the upper metal plate 159 is formed with a groove 183 located at the center in its width direction and extending in its length direction. The groove 183 extends from the vicinity of one end of the upper metal plate 159 to the vicinity of the other end thereof and does not pass through both ends, but passes through in a thickness direction thereof. By providing such a groove 183, since a relief is provided on the outer side of the curved portion of each the fine coaxial cable 31, the cables can be further prevented from coming off.

Figure 19B:
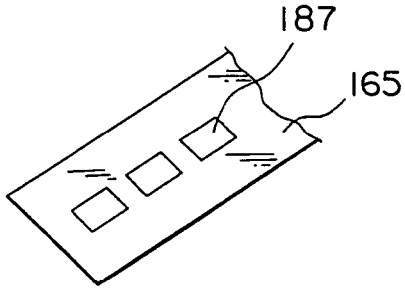
FIG. 19B is a partial perspective view showing an upper metal plate according to a fifth embodiment of this invention which is a modification of the upper metal plate of the cable line-up member shown in FIG. 18.

Further, as shown in FIG. 19B, according to the fifth embodiment of the present invention as a modification of the fourth embodiment, the groove 183 may be in the form of a plurality of consecutive holes 187.

Figure 20:
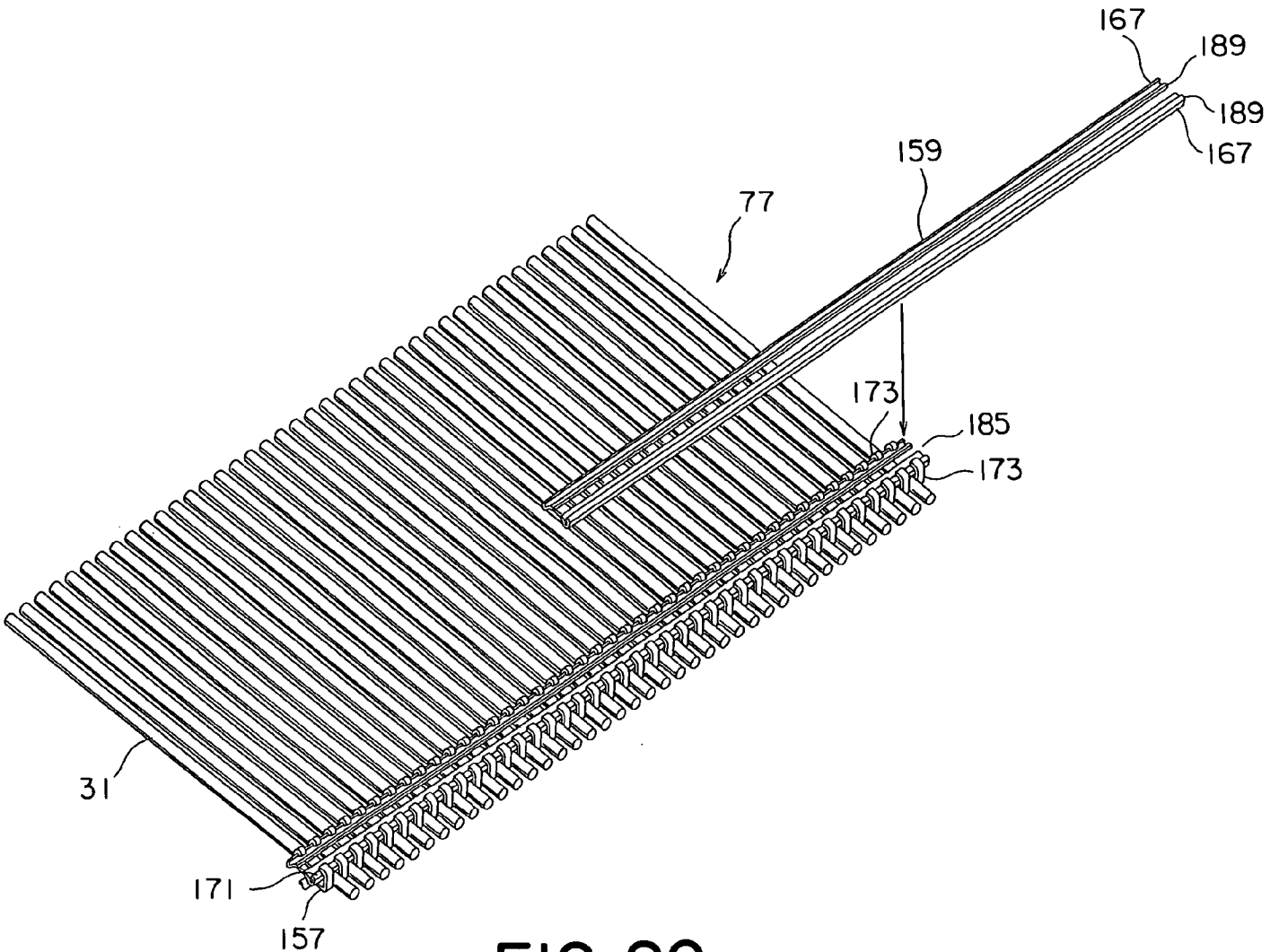
FIG. 20 is a perspective view showing a cable line-up member according to a sixth embodiment of this invention which is another modification of the cable line-up member of the connector shown in FIG. 16.
Figure 21A:
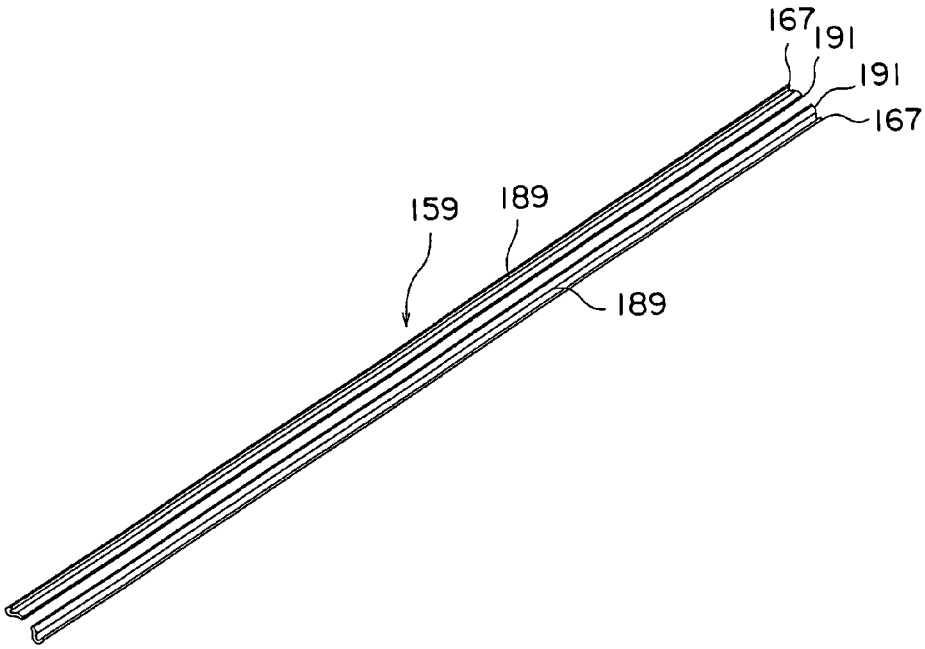
FIG. 21A is a perspective view showing an upper metal plate of the cable line-up member shown in FIG. 20.
Figure 21B:
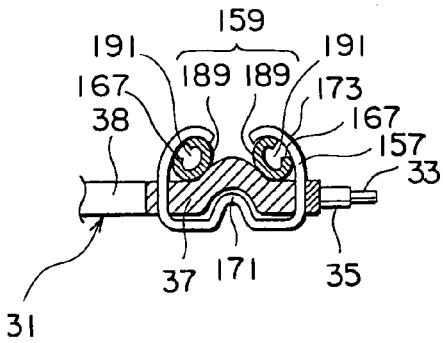
FIG. 21B is a sectional view showing the state where cables are retained by the use of the cable line-up member shown in FIG. 20.

Referring to FIGS. 20, 21A, and 21B, the upper metal plate 159 is in the form of two symmetrical semicylindrical (C-shape in cross-section) members 189, i.e. the upper metal plate 159 is formed with a groove located at the center in its width direction and extending in its length direction to pass through both ends thereof. By providing such semicylindrical members 189, since, according to the sixth embodiment of the present invention as another modification of the fifth embodiment, like in the example of FIG. 19A, the fine coaxial cables 31 are pushed up by a protrudent stripe portion of the lower metal plate and a relief is provided on the outer side of the curved portions of the cables 31, the cables 31 can be prevented from coming off.

As described above, the protrudent stripe portion 171 of the lower metal plate 157 of the cable line-up member 77 is in tight contact with the lower sides of the cables 31, the upper metal plate 159 is provided with the through holes or the groove at the center portion thereof, the presser pawls 173 press downward the upper metal plate 159, and further, the metal shell 73 is folded back at its front end, and therefore, it is possible to sufficiently resist a force in the cable draw-out direction.

As described above, in the first to sixth embodiments of this invention, since soldering is not used, bendability of the cables is not degraded so that the cables can be readily bent even at their portions close to the connector.

Further, according to the first to sixth embodiments of this invention, since there is no occurrence of adhesion of an insulating material such as a flux, a cleaning process or the like is not required and electrical contact can be stably achieved.

Further, according to the first to sixth embodiments of this invention, the cable retaining force equivalent to that of the prior art can be obtained by caulking (squashing the cables) by the use of the round bar and forming the cables into the upward and downward zigzag shape.

Now, a seventh embodiment of this invention will be described.

Figure 22:
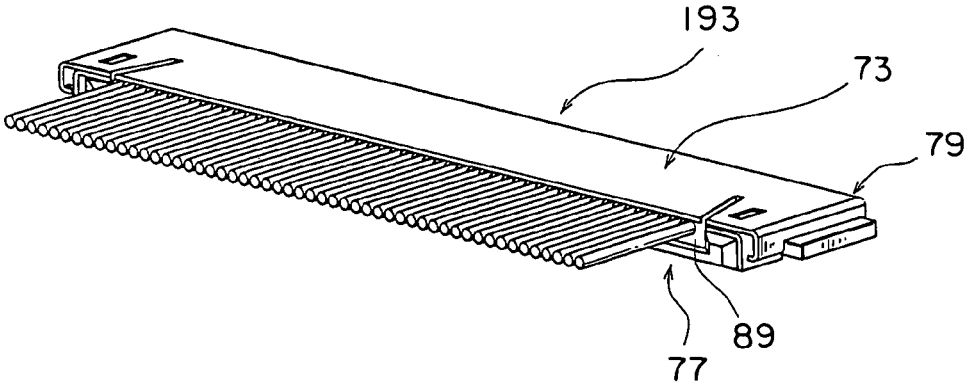
FIG. 22 is a perspective view showing a connector according to a seventh embodiment of this invention.

Referring to FIG. 22, a connector according to the seventh embodiment of this invention has substantially the same structure as that of the connector according to the third embodiment shown in FIGS. 15 and 16 except that a structure of a cable line-up member differs therefrom. That is, a connector 193 comprises the metal shell 73 being a metal outer member, the connector body 75, and the cable line-up member 77 sandwiching the fine coaxial cables 31 between the lower metal plate 157 being a first retaining element and the upper metal plate 159 being a second retaining element.

Figure 23:
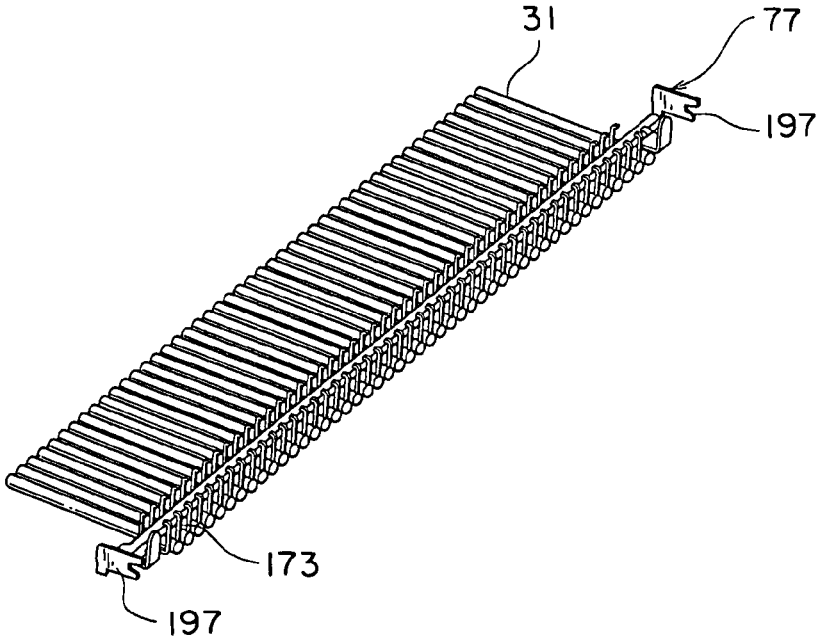
FIG. 23 is a perspective view showing a cable line-up member of the connector shown in FIG. 22.
Figure 24:
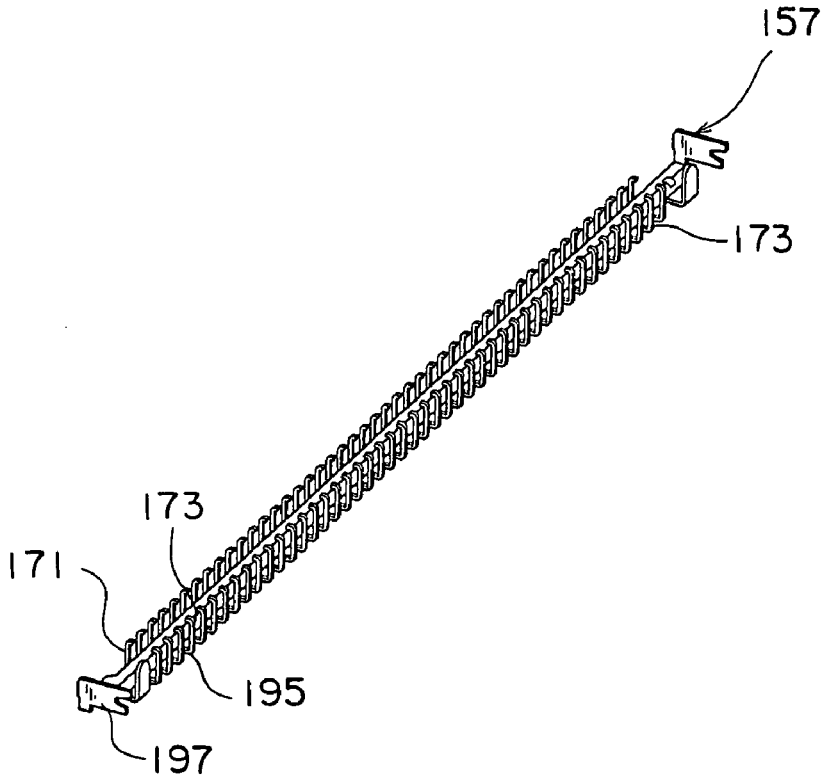
FIG. 24 is a perspective view showing a lower plate of the cable line-up member shown in FIG. 23.
Figure 25:
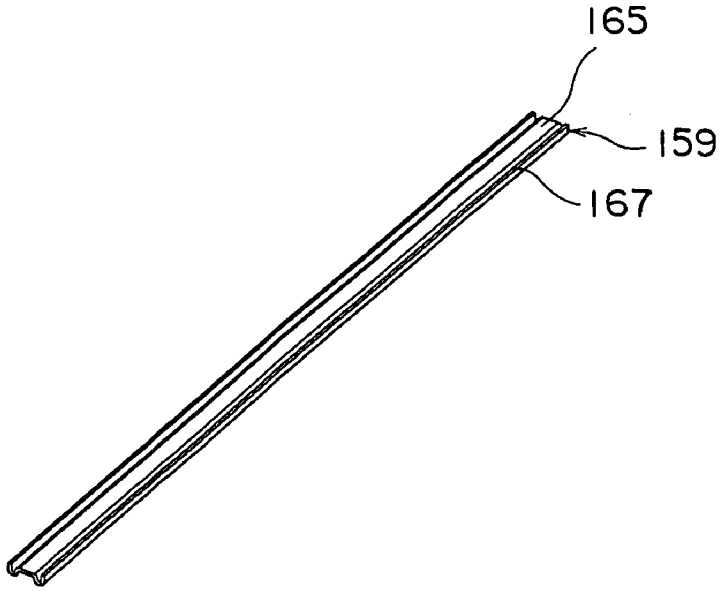
FIG. 25 is a perspective view showing an upper plate, as a first retaining element, of the cable line-up member shown in FIG. 23.

Referring to FIGS. 23, 24, and 25, the cable line-up member 77 comprises the lower metal plate 157 and the upper metal plate 159 as the retaining members and the fine coaxial cables 31 sandwiched between the lower metal plate 157 and the upper metal plate 159 as the retaining members.

Figure 26:
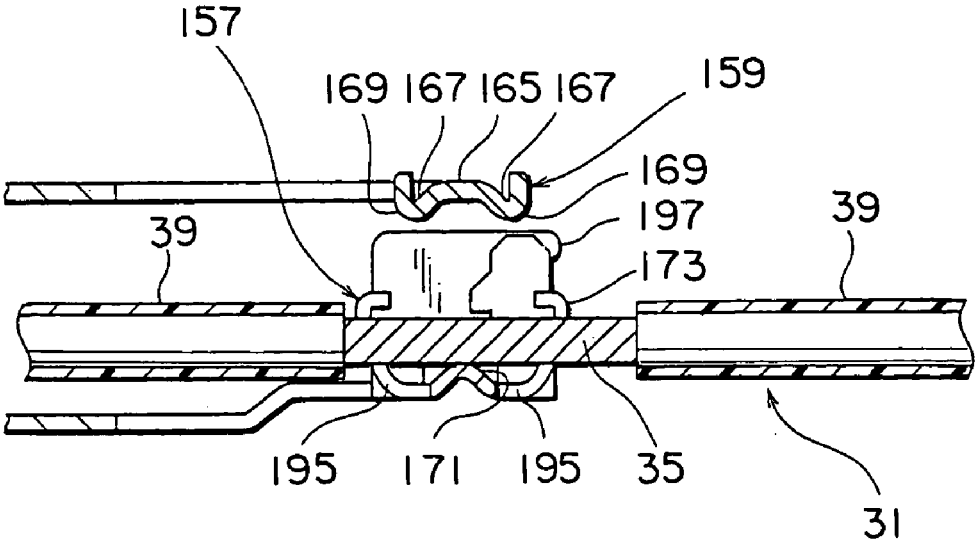
FIG. 26 is a sectional view showing the state before press-mounting of cables by retaining members of the connector shown in FIG. 22.
Figure 27:
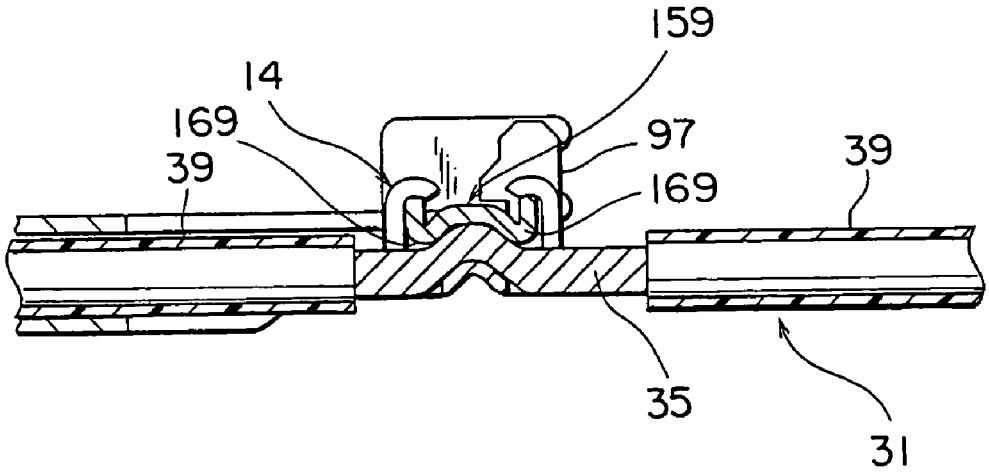
FIG. 27 is a sectional view showing the state after press-mounting of the cables by the retaining members of the connector shown in FIG. 22.

Referring to FIGS. 26 and 27, each the fine coaxial cable 31 has one end portion where the jacket 39 is removed for exposing the outer conductor 37. The insulating portion 35 and the center conductor 33 are not exposed. It may be configured such that, after the cable line-up member 77 is formed, the outer conductor 37 and the insulating portion 35 are removed in turn at a tip end portion extending further from a portion of the coaxial cable 31 that is retained in a sandwich manner, thereby exposing the center conductor 33 as shown in FIG. 16 referred to before.

As shown in FIGS. 25, 26, and 27, the upper metal plate 159 comprises the ceiling portion 165 and the grooves 167 provided on both sides thereof and each extending over the length of the ceiling portion 165. With the formation of the grooves 167, the upper metal plate 159 is in the form of a metal plate having the projected portions 169 on the back side and having a trapezoidal shape in cross-section.

As shown in FIGS. 24, 26, and 27, the lower metal plate 157 comprises the protrudent stripe portion 171 provided at the center and extending over the length of the lower metal plate 157. The lower metal plate 157 further comprises a plurality of presser pawls 173 provided on both sides of the protrudent stripe portion 171. The presser pawls 173 are arranged in the length direction on each side of the protrudent stripe portion 171 at a constant pitch to form a comb-tooth shape. Further, cut-out portions 195 are provided between the presser pawls 173 on both sides of the protrudent stripe portion 171. Support strips 197 for mounting to the connector are further provided at both ends of the protrudent stripe portion 171. These support strips 197 are electrically connected to the shell when mounted to the connector.

Now, description will be given of an operation of the cable line-up member 77 according to the seventh embodiment of this invention.

Referring to FIGS. 26 and 27, each of the fine coaxial cables 31 comprises the center conductor 33, the insulating portion 35 around the center conductor 33, the outer conductor 37 around the insulating portion 35, and the jacket 39 covering around the outer conductor 37. Near one end of the fine coaxial cables 31, the outer conductors 37 are sandwiched between the adjacent presser pawls 173 of the lower metal plate 157 and slightly squashed. In this state, the upper metal plate 159 is mounted from above while passing under the presser pawls 173 serving as the fixing portions. In this event, although the tip ends of the presser pawls 173 are in an open state, when pushed downward by the movement of the upper metal plate 159, the tip ends of the presser pawls 173 confronting each other in the length direction of the cables approach each other to reach a state where the distance therebetween is narrowed, i.e. a closed state. In this closed state, the tip ends of the presser pawls 173 engage with the grooves 167 formed on the upper side of the upper metal pate 159 on both sides thereof so that the upper metal plate 159 slidingly moves in the length direction and is retained in the state as shown in FIG. 27. In this state, the outer conductors 37 are mechanically retained between the protrudent stripe portion 171 and the projected portions 169 so that the lower and upper metal plates 157 and 159 and the outer conductors 37 of the coaxial cables 31 are electrically connected together. Accordingly, the cable line-up member 77 is formed as best shown in FIG. 27 where each the outer conductor 37 is fixedly retained in a meandering or zigzag fashion between the projected portions 169 and a recessed portion therebetween of the upper metal plate 159 and the protrudent stripe portion 171 of the lower metal plate 157. Herein, the cut-out portions 195 of the lower metal plate 157 serve as relief portions for the cables. By fixedly retaining the fine coaxial cables 31 in the zigzag fashion, the cable retaining force is enhanced. In the connector according to the seventh embodiment of this invention, since the cut-out portions 195 are provided on both sides of the center protrudent stripe portion 171 of the lower metal plate 157 being the first retaining element, the relief portions for the cables are provided when the cables 31 are pushed by the upper metal plate 159 being the second retaining element and, therefore, by adjusting the pressure using the center protrudent portion 171 of the lower metal plate 157 as a reference, it is possible to reduce occurrence of shorts between the center conductors and the outer conductors which are caused by pressurization.

When the cable line-up member 77 shown in FIG. 23 is mounted in the cable receiving portion 89 of the connector body 75, a state shown in FIG. 22 is obtained. A section thereof is the same as that shown in FIG. 16, wherein the presser pawls 173 of the lower metal plate 157 and the plate springs of the shell 73 are electrically connected together.

In the seventh embodiment of this invention as described above, since the cut-out portions 195 are provided on both sides of the protrudent stripe portion 171, the shape of the lower metal plate 157 being the first retaining element facilitates the processing of a metal member.

Further, since soldering is not used in the ground connection, the connector 193 is excellent in bendability of the cables.

In the connector 193, by determining sizes of the center protrudent stripe portion of the first retaining element and the center recessed portion of the second retaining element, connection to the outer conductors can be stably maintained.

In the connectors according to the foregoing third to sixth embodiments, since both sides of the protrudent stripe portion of the lower metal plate 157 are in the form of recessed portions, when the aligned fine coaxial cables 31 are pressed by the upper metal plate 159, there is a possibility that the coaxial cables are overpressed to cause shorts between the center conductors and the outer conductors.

However, in the connector 193 according to the seventh embodiment of this invention, the outer conductor exposed portions where the jacket of the coaxial cables arranged at the predetermined pitch is cut off are aligned by the first retaining element 157 having the cable line-up retaining portion and the cables are pressed by the second retaining element 159 so that the ground connection can be carried out collectively.

Further, in the ground connection using soldering, there is the disadvantage in that breakage of the outer conductors occurs due to solder wicking, the bendability of the cables is degraded, and connection failure due to use of a flux is liable to occur. However, according to the embodiment of this invention, since the relief portions for the cables in the form of the cut-outs 195 are provided at the lower metal plate 157, it is possible to provide a connector having a structure wherein there is no occurrence of connection failure due to solder wicking or adhesion of a flux and the fine coaxial cables can be reliably retained and electrically connected.

According to this invention, it is possible to provide a connector that does not degrade the bendability of the cables because of not using soldering in fixing the outer conductors so that the cables can be readily bent even at their portions close to the connector.

Further, according to this invention, it is possible to provide a connector that does not require a cleaning process because there is no occurrence of adhesion of an insulating material such as a flux used in solder flow, thereby enabling stable electrical contact.

Further, according to this invention, it is possible to provide a connector that can achieve a cable retaining force equivalent to that of the prior art by caulking (squashing the cables) by the use of the round bar and forming the cables into the upward and downward zigzag shape.

The connector according to this invention is applied to connection of cables or the like to an electrical/electronic device.

While the present invention has thus far been described in connection with the preferred embodiments thereof, it will readily be possible for those skilled in the art to put this invention into practice in various other manners.

What is claimed is:

1. A connector for connecting to cables, comprising a retaining member for aligning and retaining said cables, wherein said retaining member comprises a first retaining element and a second retaining element, said first retaining element has plural of fixing portions for retaining said cables therebetween and for fixedly retaining said second retaining element, each of said cables is retained between said first and said second retaining elements to have a meandering portion adjacent to said first and said second retaining elements, and said first and second retaining elements are electrically connected to said cable by sandwiching around portions of said cables between said first and said second retaining elements.

2. A connector according to claim 1, wherein said first retaining element comprises a body portion, said second retaining element comprises a bar-shaped member, and said cables are sandwiched between said body portion and said bar-shaped portion.

3. A connector according to claim 2, wherein said bar-shaped portion is arranged so that its length direction crosses a length direction of each cable and that said plurality of fixing portions are arranged along the length direction of said bar-shaped portion.

4. A connector according to claim 2, wherein said connector has a shell, said body portion has a protrudent portion, and said cables are sandwiched in a zigzag fashion between said shell and said protrudent portion.

5. A connector according to claim 4, wherein said shell has an end portion projected in a direction that crosses a length direction of each cable.

6. A connector according to claim 1, wherein said first and second retaining elements have a first and a second plate, respectively, confronting each other, said first plate is provided with said fixing portions at its both ends in a length direction of each cable, and one of said first and second plates has a protrudent portion, as a cable support portion, at a center position between said fixing portions provided at said both ends in the length direction of each cable.

7. A connector according to claim 6, wherein said retaining member and said cables are mechanically retained and electrically connected together by sandwiching ground portions of said cables.

8. A connector according to claim 6, wherein said first plate and said second plate are each formed so as to extend in a direction crossing the length direction of each cable.

9. A connector according to claim 6, wherein the other of said first and second plates is divided into two in the length direction of each cable with respect to a portion confronting said protrudent portion so as to be formed as independent components of each other.

10. A connector according to claim 9, wherein each of said independent components has a C-shape in cross-section.

11. A connector according to claim 6, wherein the other of said first and second plates is provided with a groove at a portion corresponding to said protrudent portion.

12. A connector according to claim 11, wherein said groove is provided at each of positions corresponding to said cables in a direction crossing said cables and has a length greater than a thickness of each cable.

13. A connector according to claim 1, wherein said first retaining element has a protrudent portion at a center portion in a length direction of each cable and has cable relief portions formed by cutting adjacent portions, between said fixing portions, of said first retaining element toward said protrudent portion.

14. A connector according to claim 1, wherein said connector has an elongated box shape, receives said retaining member at one end side of the connector in a width direction crossing a length direction of the elongated box shape, and has a fitting portion for fittingly receiving a counterpart connector at one end surface of the connector in a thickness direction thereof.

15. A connector according to claim 14, further comprising a metal shell covering at least the other end surface opposite to said fitting portion.

16. A connector according to claim 14, wherein said fitting portion is provided with contacts each having one end exposed for contacting a corresponding one of counterpart contacts and the other end connected to a center conductor of the corresponding cable retained by said retaining member.

17. A connector according to claim 14, further comprising a box-shaped insulator, contacts retained by said insulator, and a shell covering one surface of said insulator, said retaining member being received between said shell and said insulator at one end side of the connector in the width direction, the fitting portion being for fittingly receiving the counterpart connector at one end surface of the connector in the thickness direction thereof, wherein each contact has one end exposed at said fitting portion and the other end connected to a center conductor of the corresponding cable retained by said retaining member.

* * * * *